US009033141B2

(12) United States Patent
Ghini et al.

(10) Patent No.: US 9,033,141 B2
(45) Date of Patent: May 19, 2015

(54) PACKET OF CIGARETTES, AND METHOD OF PRODUCING A PACKET OF CIGARETTES

(71) Applicant: G. D. SOCIETA' PER AZIONI, Bologna (IT)

(72) Inventors: Marco Ghini, Monte San Pietro (IT); Roberto Polloni, Modigliana (IT); Andrea Biondi, Bologna (IT)

(73) Assignee: G. D. SOCIETA' PER AZIONI, Bologna (IT)

( * ) Notice: Subject to any disclaimer, the term of this patent is extended or adjusted under 35 U.S.C. 154(b) by 0 days.

(21) Appl. No.: 14/159,749

(22) Filed: Jan. 21, 2014

(65) Prior Publication Data

US 2014/0131232 A1 May 15, 2014

Related U.S. Application Data

(62) Division of application No. 13/390,163, filed as application No. PCT/IB2010/002023 on Aug. 13, 2010, now abandoned.

(30) Foreign Application Priority Data

Aug. 13, 2009 (IT) ..... BO2009A0546

(51) Int. Cl.
*A24F 15/12* (2006.01)
*B65B 61/18* (2006.01)
(Continued)

(52) U.S. Cl.
CPC ..... *A24F 15/12* (2013.01); *B65B 61/18* (2013.01); *B65D 5/728* (2013.01); *B65D 85/1036* (2013.01); *B65B 19/226* (2013.01); *B65D 85/10* (2013.01)

(58) Field of Classification Search
CPC ..... A24F 15/12; A24F 15/00; B65D 85/10; B65D 85/1027; B65D 85/1045
USPC ..... 206/267, 273, 242, 254, 249, 271, 270, 206/265, 264, 245, 268
See application file for complete search history.

(56) References Cited

U.S. PATENT DOCUMENTS 727,600 A 5/1903 Doscher
1,291,984 A 1/1919 Mahoney
(Continued)

FOREIGN PATENT DOCUMENTS

DE 28 581 66 C2 8/1985
EP 0 330 969 A1 9/1989
(Continued)

OTHER PUBLICATIONS

International Search Report for International Application No. PCT/IB2010/002023, dated Apr. 28, 2011.

*Primary Examiner* — Steven A. Reynolds
(74) *Attorney, Agent, or Firm* — Marshall, Gerstein & Borun LLP

(57) ABSTRACT

A packet (1) of cigarettes having: an inner package (2) defined by a group (30) of cigarettes wrapped in a sheet (29) of wrapping material having at least one tear line (32) defining a tear-off top portion (31); an inner container (4) housing the inner package (2) and having an extraction opening (10) for access to the tear-off top portion (31); an outer container (5) housing the inner container (4) in sliding manner, to allow the inner container (4) to slide, with respect to the outer container (5), between a closed position, in which the inner container (4) is inserted inside the outer container (5), and an open position, in which the inner container (4) is extracted partly from the outer container (5); and a tear-off lid (45) connected to the inner container (4) by at least one tear line (48), and covering at least part of the extraction opening (10).

14 Claims, 29 Drawing Sheets

(51) Int. Cl.

| | |
|---|---|
| ***B65D 5/72*** | (2006.01) |
| ***B65D 85/10*** | (2006.01) |
| ***B65B 19/22*** | (2006.01) |

(56) References Cited

U.S. PATENT DOCUMENTS

| | | | | |
|---|---|---|---|---|
| 1,877,468 | A | | 9/1932 | L'Enfant |
| 3,093,292 | A | | 6/1963 | Ahlbor |
| 3,276,668 | A | | 10/1966 | Tamarin et al. |
| 3,749,234 | A | | 7/1973 | Gero |
| 4,534,463 | A | | 8/1985 | Bouchard |
| 4,559,758 | A | | 12/1985 | Gamberini |
| 4,949,841 | A | | 8/1990 | Focke et al. |
| 5,080,227 | A | * | 1/1992 | Focke ..... 206/273 |
| 5,435,439 | A | | 7/1995 | Swart |
| 5,682,986 | A | | 11/1997 | Cobler |
| 6,158,579 | A | | 12/2000 | Rosenbaum |
| 6,244,435 | B1 | | 6/2001 | Cho |
| 7,290,652 | B2 | | 11/2007 | Rath |
| 7,377,385 | B2 | | 5/2008 | Giannini et al. |
| 7,624,860 | B2 | | 12/2009 | Roila et al. |
| 7,770,724 | B2 | | 8/2010 | Ghini et al. |
| 7,866,466 | B2 | | 1/2011 | Rose et al. |
| 2004/0031704 | A1 | | 2/2004 | Amos |
| 2005/0241966 | A1 | | 11/2005 | Giannini et al. |
| 2007/0278115 | A1 | | 12/2007 | Ghini et al. |
| 2008/0289977 | A1 | | 11/2008 | Ghini et al. |
| 2009/0045084 | A1 | | 2/2009 | Roila et al. |
| 2010/0176010 | A1 | | 7/2010 | Tearle |
| 2011/0062037 | A1 | | 3/2011 | Bertuzzi et al. |
| 2013/0140201 | A1 | | 6/2013 | Ghini et al. |

FOREIGN PATENT DOCUMENTS

| | | | |
|---|---|---|---|
| FR | 2499947 | A3 | 8/1982 |
| GB | 447419 | | 5/1936 |
| IT | 1169163 | B | 5/1987 |
| WO | WO-9636538 | A2 | 11/1996 |
| WO | WO-00/10892 | A1 | 3/2000 |
| WO | WO-0010879 | A2 | 3/2000 |
| WO | WO-2006/021581 | A1 | 3/2006 |
| WO | WO-2007/128822 | A1 | 11/2007 |

* cited by examiner

PACKET OF CIGARETTES, AND METHOD OF PRODUCING A PACKET OF CIGARETTES

CROSS-REFERENCE TO RELATED APPLICATIONS

This is a divisional of U.S. patent application Ser. No. 13/390,163, filed Apr. 27, 2012, which is the U.S. national phase of PCT/IB2010/002023, filed Aug. 13, 2010, which claims the benefit of Italian Patent Application No. B02009A 000546, filed Aug. 13, 2009.

TECHNICAL FIELD

The present invention relates to a packet of cigarettes, and to a method of producing a packet of cigarettes.

The present invention is particularly advantageous for producing a slide-open packet of cigarettes comprising two partly separable containers inserted one inside the other, to which the following description refers purely by way of example.

BACKGROUND ART

A rigid, slide-open packet of cigarettes comprises a first container, which houses an inner package (defined by a group of cigarettes wrapped in a sheet of foil inner wrapping material) and is housed inside a second container to slide, with respect to the second container, between a closed position, in which the first container is inserted inside the second container, and an open position, in which the first container is extracted partly from the second container. The first container may slide straight with respect to the second container or swing about a hinge connecting the two containers. Some embodiments of rigid, straight-slide-open packets of cigarettes are described in FR2499947A1, U.S. Pat. No. 4,534,463A1, U.S. Pat. No. 5,080,227A1 and IT1169163B, and one embodiment of a rigid, swing-open packet of cigarettes is described in WO2006021581.

The sheet of foil inner wrapping material has a tear-off top portion bounded by a so-called pull-off line, and which is torn off for access to the cigarettes when the packet is unsealed. In the case of a rigid, slide-open packet of cigarettes, only part of the top wall of the inner package is accessible to the user (unlike a conventional rigid, hinged-lid packet of cigarettes), so the tear-off top portion also only involves a limited portion of the top wall of the inner package.

The sheet of foil inner wrapping material is always in the form of an elongated rectangle, and is first folded into a U about the group of cigarettes. Depending on the design of the packing machine on which the packet of cigarettes is produced, the sheet of inner wrapping material may first be folded into a U crosswise or longitudinally about the group of cigarettes. When the sheet of inner wrapping material of a rigid, slide-open packet of cigarettes is first folded into a U crosswise about the group of cigarettes, the tear-off top portion is defined by one part of the sheet of inner wrapping material bounded by one pull-off line.

Conversely, when the sheet of inner wrapping material of a rigid, slide-open packet of cigarettes is first folded into a U longitudinally about the group of cigarettes, the tear-off top portion is defined by two separate parts of the sheet of inner wrapping material, located at opposite ends of the sheet and bounded by two corresponding pull-off lines, as described, for example, in U.S. Pat. No. 5,080,227A1. A tear-off top portion comprising two separate parts of the sheet of inner wrapping material is unpractical, by forcing the user, when unsealing the packet, to tear off the top portion in two consecutive operations (one for each part of the tear-off top portion) as opposed to one single operation.

Moreover, parts of the tear-off top portion of a rigid, slide-open packet of cigarettes may lift off the rest of the inner package and jam against the inner surface of the outer container, thus making it difficult (if not impossible without tearing the packing material) to unseal the packet. (This problem only applies when unsealing the packet, in that, once the packet is unsealed, the tear-off top portion is removed).

DESCRIPTION OF THE INVENTION

It is an object of the present invention to provide a packet of cigarettes, and a method of producing a packet of cigarettes, which are designed to eliminate the above drawbacks and, at the same time, are cheap and easy to implement.

According to the present invention, there are provided a packet of cigarettes, and a method of producing a packet of cigarettes, as claimed in the accompanying Claims.

BRIEF DESCRIPTION OF THE DRAWINGS

A number of non-limiting embodiments of the present invention will be described by way of example with reference to the accompanying drawings, in which.

PREFERRED EMBODIMENTS OF THE INVENTION

Figure 1:
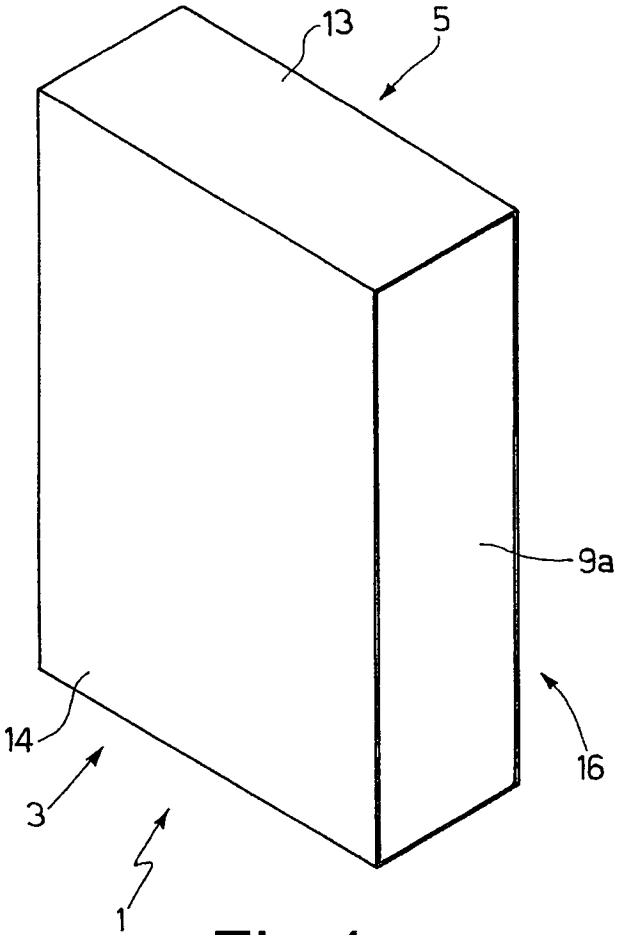
FIG. 1 shows a front view in perspective of a rigid, straight-slide-open packet of cigarettes in a closed configuration.

Number 1 in FIG. 1 indicates as a whole a rigid, straight-slide-open packet of cigarettes.

The packet 1 of cigarettes shown in FIG. 1 comprises an inner package 2 defined by a group of cigarettes wrapped in a sheet of foil inner wrapping material; and a rigid outer package 3 made of cardboard or similar, and housing inner package 2. Outer package 3 in turn comprises a rigid inner container 4 actually housing inner package 2; and a rigid outer container 5 housing inner container 4 to allow inner container 4 to slide, with respect to outer container 5 and in a straight (translatory) movement, between a closed position (FIG. 1), in which inner container 4 is inserted completely inside outer container 5, and an open position (FIG. 2), in which inner container 4 is partly extracted from outer container 5 for direct user access to inner package 2.

Figure 3:
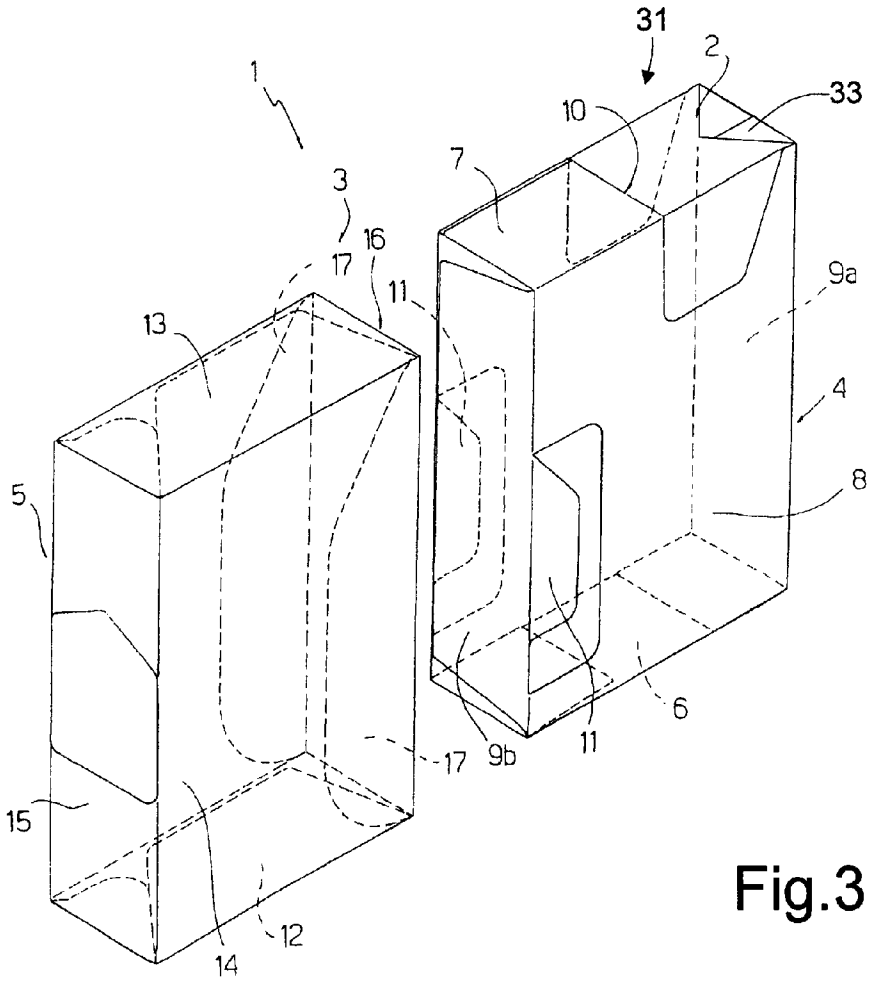
FIG. 3 shows an exploded view in perspective of the FIG. 1 packet of cigarettes.

As shown in FIG. 3, inner container 4 is parallelepiped-shaped, and has a bottom wall 6, a top wall 7, two opposite parallel major lateral walls 8, and two parallel minor lateral walls 9*a*, 9*b* interposed between major lateral walls 8. Close to minor lateral wall 9*a*, top wall 7 has an extraction opening 10, which also extends over part of major lateral walls 8 and, when inner container 4 is in the open position, is located outside outer container 5 to allow the user to open inner package 2 and withdraw the cigarettes from inner container 4. A retaining tab 11 is cut into each major lateral wall 8, close to minor lateral wall 9*b*, and projects outwards of inner container 4 from the edge between relative major lateral wall 8 and minor lateral wall 9*b*. Four longitudinal edges are defined between major lateral walls 8 and minor lateral walls 9, and eight transverse edges are defined between lateral walls 8, 9 and walls 6, 7.

As shown in FIG. 3, outer container 5 is also parallelepiped-shaped, and has a bottom wall 12, a top wall 13, two opposite parallel major lateral walls 14, a minor lateral wall 15, and an opening 16 opposite minor lateral wall 15 and through which inner container 4 slides. A retaining tab 17 is connected to the edge of each major lateral wall 14 bounding opening 16, projects inwards of outer container 5 from relative major lateral wall 14, and, as inner container 4 is extracted, engages a corresponding retaining tab 11 of inner container 4 to limit the outward travel of inner container 4 and prevent it from detaching completely from outer container 5. Two longitudinal edges are defined between major lateral walls 14 and minor lateral wall 15; and six transverse edges are defined between lateral walls 14, 15 and walls 12, 13.

Minor lateral wall 15 of outer container 5 has a central hole shaped and sized to allow the user to exert pressure, through minor lateral wall 15, on minor lateral wall 9*b* of inner container 4, to slide inner container 4 into the open position.

In one embodiment, weak-stick, non-dry glue (i.e. non-permanent glue that allows parts to be pulled apart and reglued repeatedly without losing its adhesive properties) is applied between minor lateral wall 15 of outer container 5 and minor lateral wall 9*b* of inner container 4 (i.e. the minor lateral wall resting against minor lateral 15 of outer container 5 in the closed position), so that, in the closed position, minor lateral wall 9*b* is glued weakly to minor lateral wall 15 to hold inner container 4 firmly in the closed position.

Figure 2:
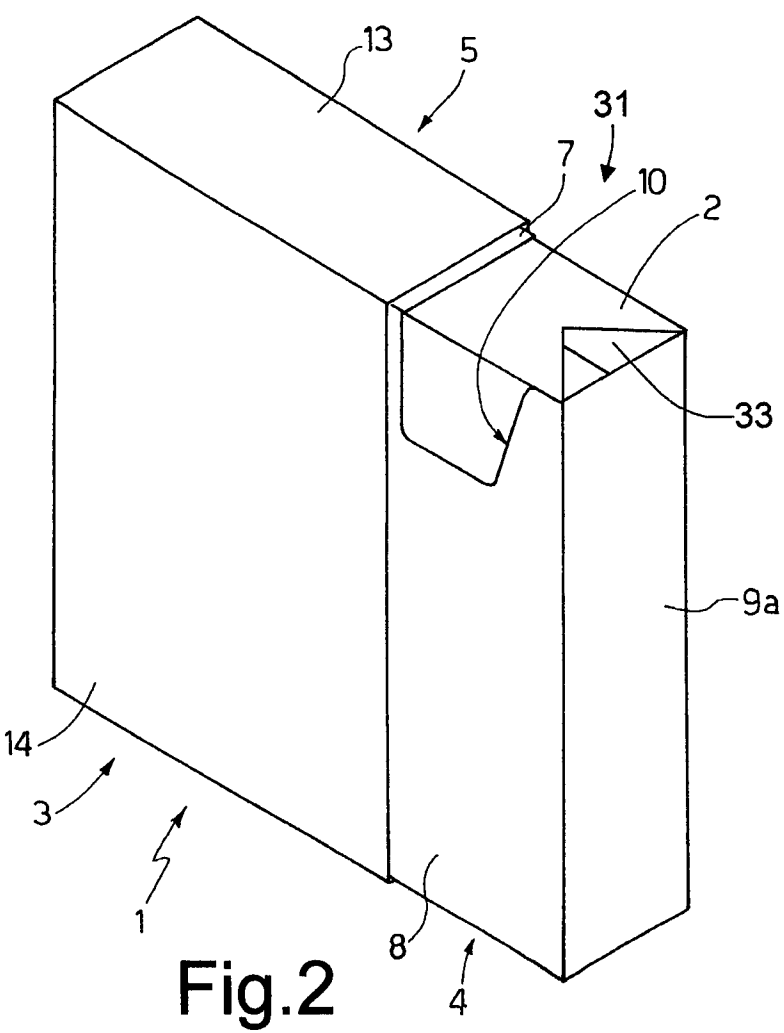
FIG. 2 shows a front view in perspective of the FIG. 1 packet of cigarettes in an open configuration.

In the FIG. 1-3 embodiment, the longitudinal and transverse edges of containers 4 and 5 are all straight. In other embodiments, not shown, at least one of the edges of containers 4 and 5 may be other than straight, e.g. rounded or bevelled.

Figure 4:
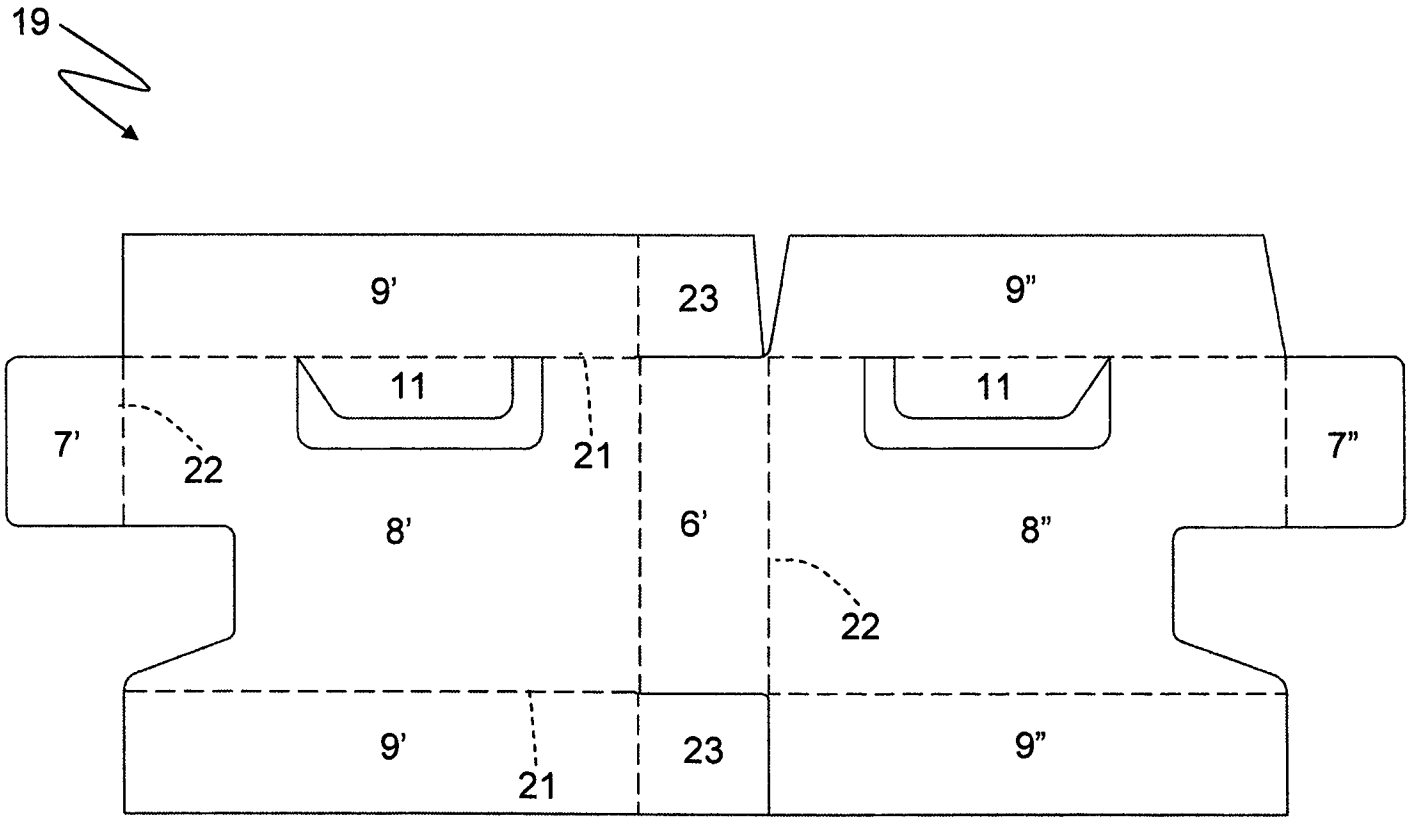
FIG. 4 shows a plan view of a blank from which to form an inner container of the FIG. 1 packet of cigarettes.
Figure 5:
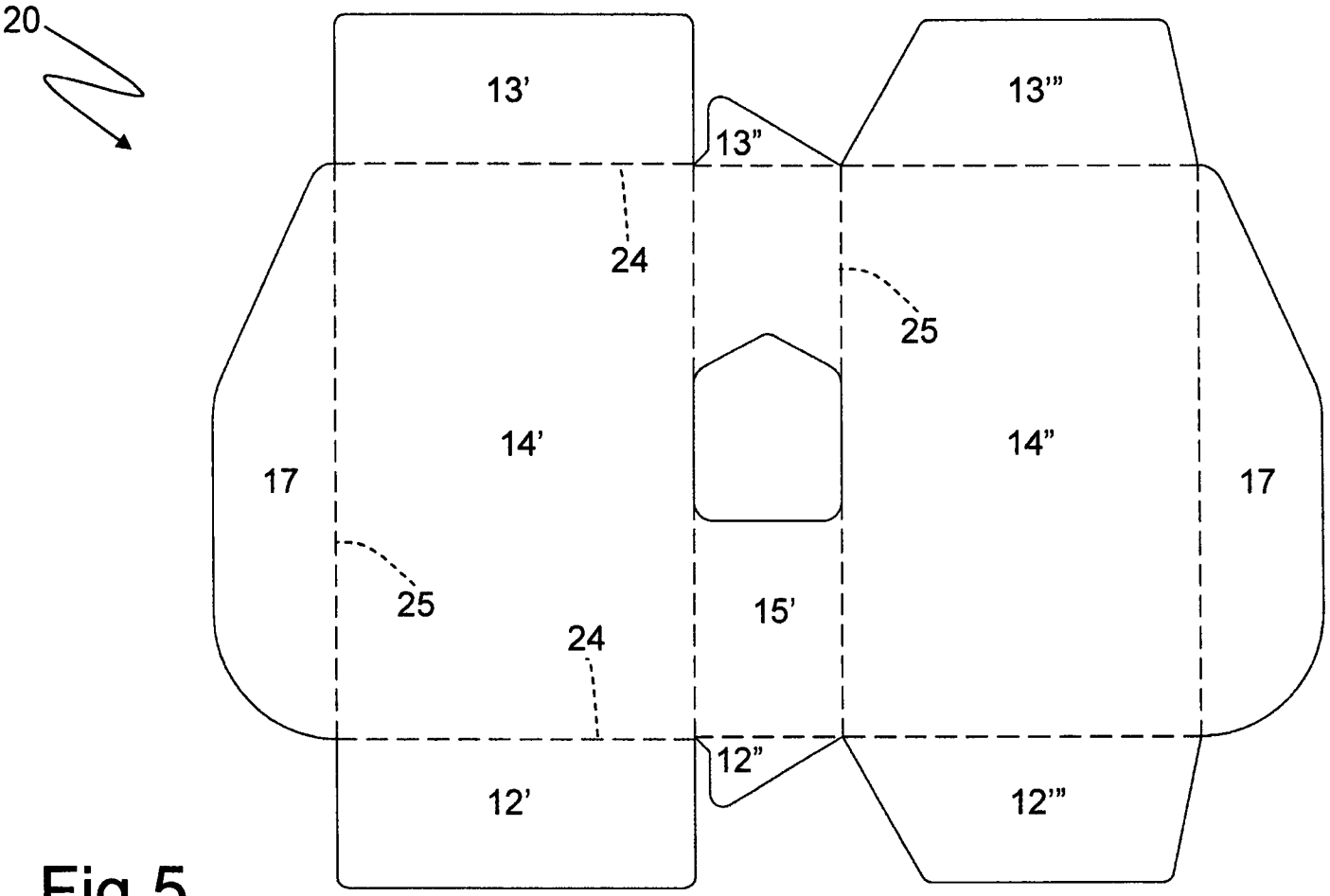
FIG. 5 shows a plan view of a blank from which to form an outer container of the FIG. 1 packet of cigarettes.

Containers 4 and 5 of the FIG. 1-3 packet 1 of cigarettes are formed by folding respective known blanks 19 and 20 shown in FIGS. 4 and 5 respectively. Blanks 19 and 20 each comprise, among other things, a number of panels, which are indicated, where possible, using the same reference numbers, with superscripts, as for the corresponding walls of respective container 4, 5.

With reference to FIG. 4, blank 19 has two longitudinal fold lines 21, and a number of transverse fold lines 22 defining, between longitudinal fold lines 21, a panel 7' forming part of top wall 7; a panel 8' forming one major lateral wall 8; a panel 6' forming bottom wall 6; a panel 8" forming the other major lateral wall 8; and a panel 7" forming the rest of top wall 7.

Panel 8' has two lateral wings 9', which form respective inner portions of minor lateral walls 9, are located on opposite sides of panel 8', and are separated from panel 8' by longitudinal fold lines 21. Panel 8" has two lateral wings 9", which form respective outer portions of minor lateral walls 9, are located on opposite sides of panel 8", and are separated from panel 8" by longitudinal fold lines 21. Each lateral wing 9' of panel 8' has a tab 23 separated from lateral wing 9' by a transverse fold line 22. And a window, defining a respective retaining tab 11, is formed in each panel 8', 8".

With reference to FIG. 5, blank 20 has two transverse fold lines 24, and a number of longitudinal fold lines 25 defining, between transverse fold lines 24, a panel 14' forming one major lateral wall 14; a panel 15' forming minor lateral wall 15; and a panel 14" forming the other major lateral wall 14. And each panel 14', 14" has a retaining tab 17 located on the opposite side to panel 15' and separated from respective panel 14', 14" by a longitudinal fold line 25.

Panel 14' has two rectangular end wings 12' and 13', which are located at opposite ends of panel 14', are separated from panel 14' by transverse fold lines 24, and form respective outer portions of walls 12 and 13. Panel 15' has two end wings 12" and 13", which are located at opposite ends of panel 15', are separated from panel 15' by transverse fold lines 24, are triangular in shape with a rounded outer vertex, and form respective inner portions of walls 12 and 13. Panel 14" has two trapezoidal end wings 12'" and 13'", which are located at opposite ends of panel 14", are separated from panel 14" by transverse fold lines 24, and form respective inner portions of walls 12 and 13. And end wings 12", 12'" and 13", 13'" are shaped so as not to overlap when folded onto end wings 12' and 13' to form walls 12 and 13 of outer container 5.

Figure 6:
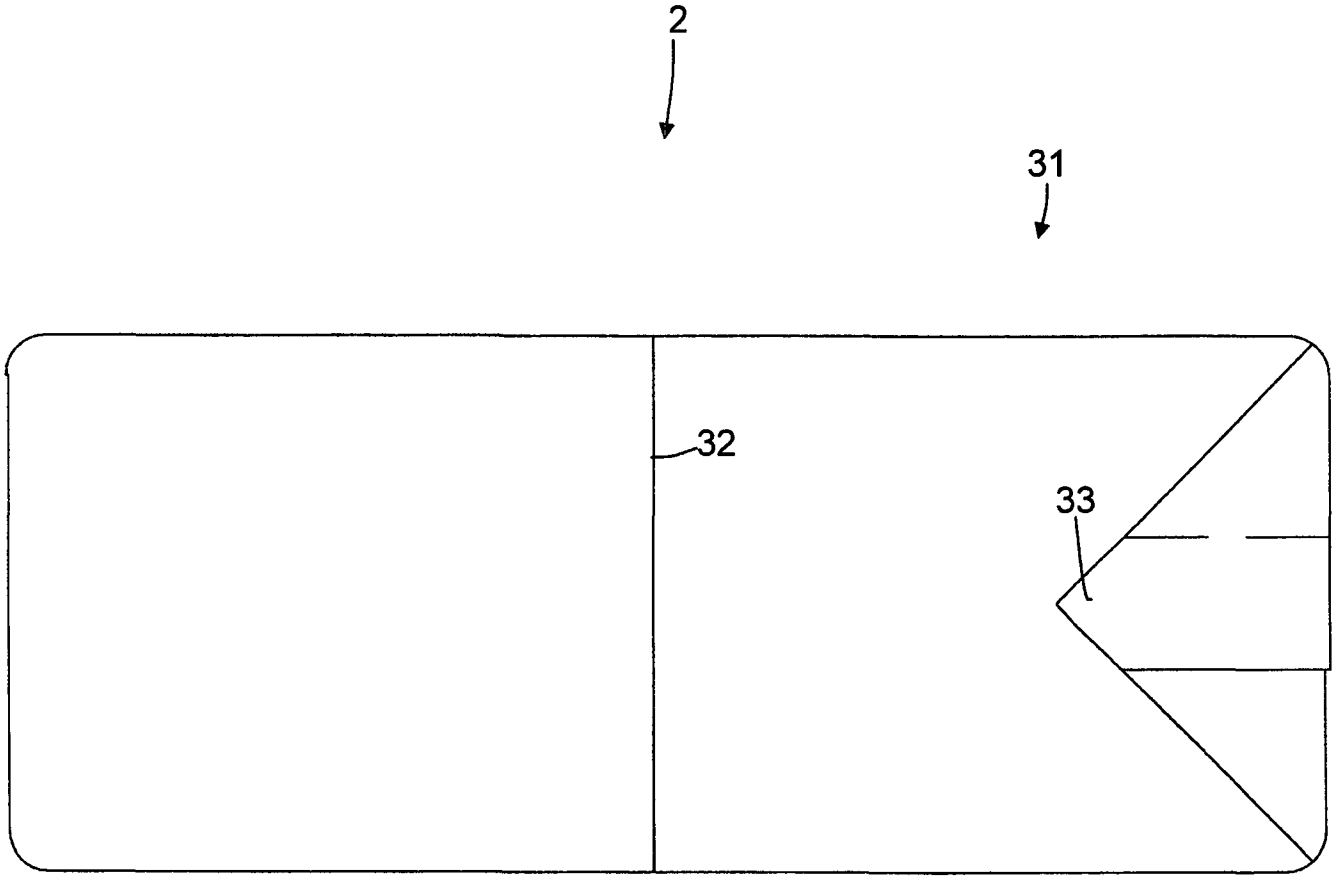
FIG. 6 shows a plan view of a top wall of an inner package of the FIG. 1 packet of cigarettes.
Figure 7:
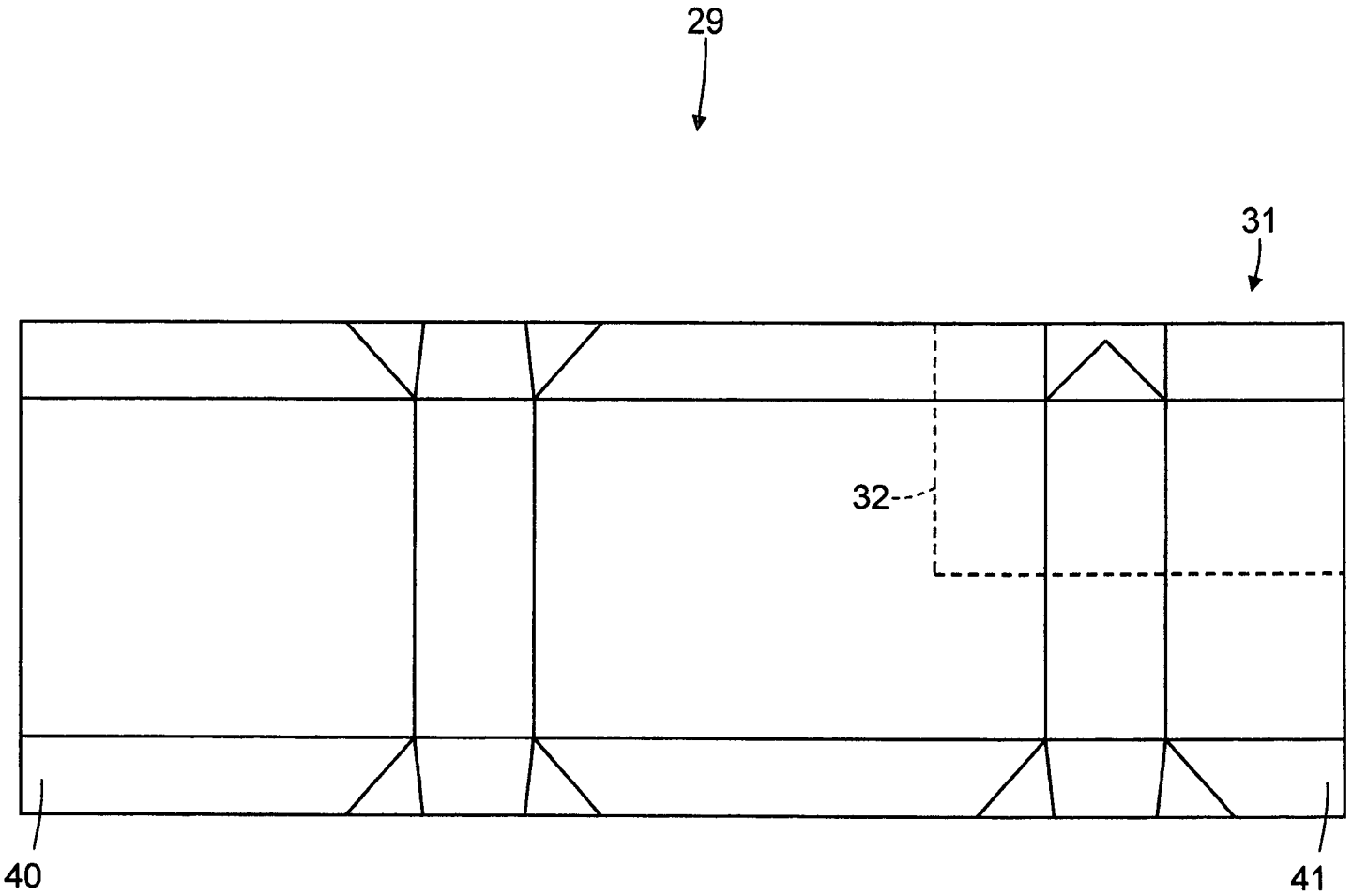
FIG. 7 shows a plan view of a sheet of inner wrapping material from which to form the FIG. 6 inner package.
Figure 8:
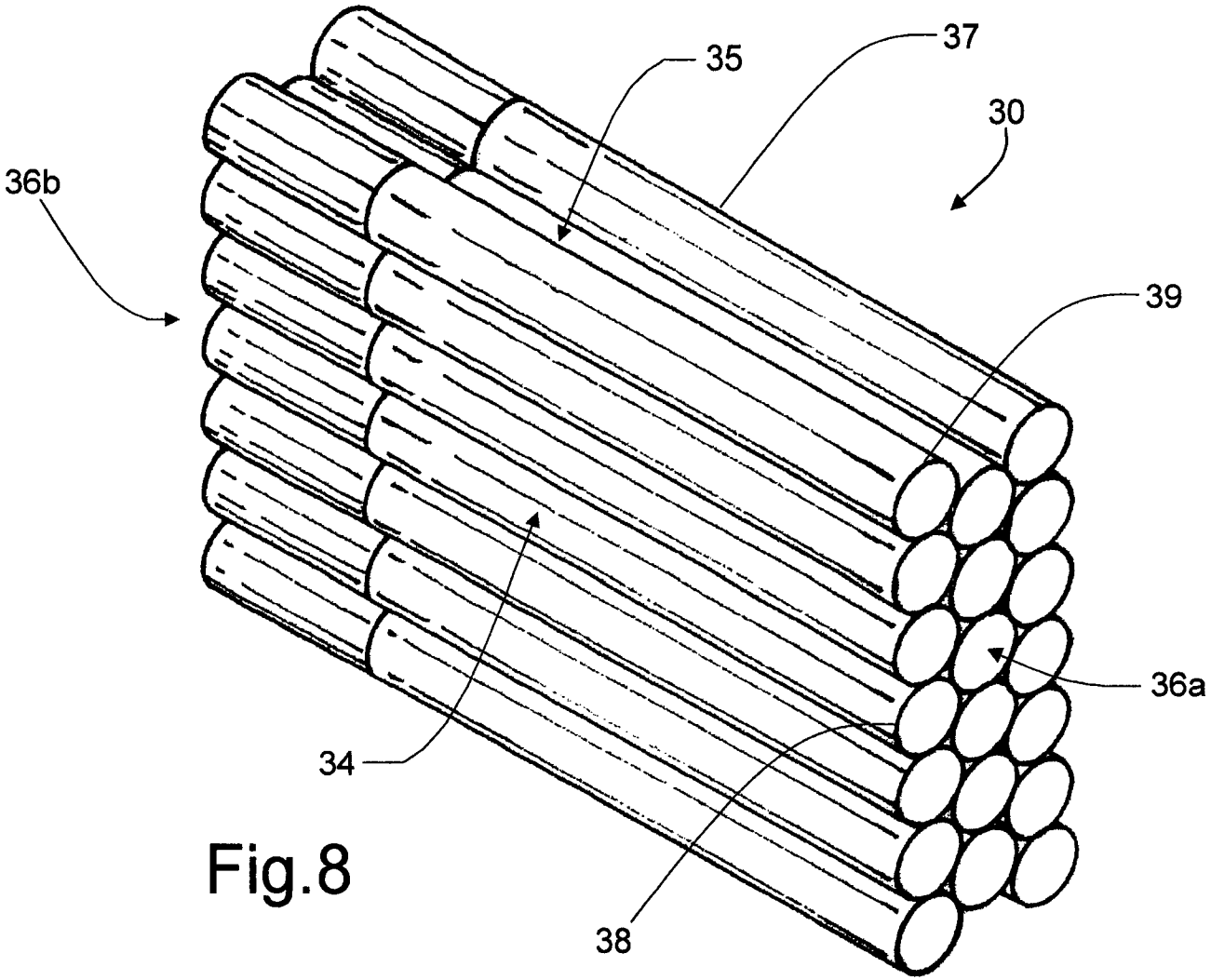
FIG. 8 shows a view in perspective of a group of cigarettes contained in the FIG. 6 inner package.
Figure 10:
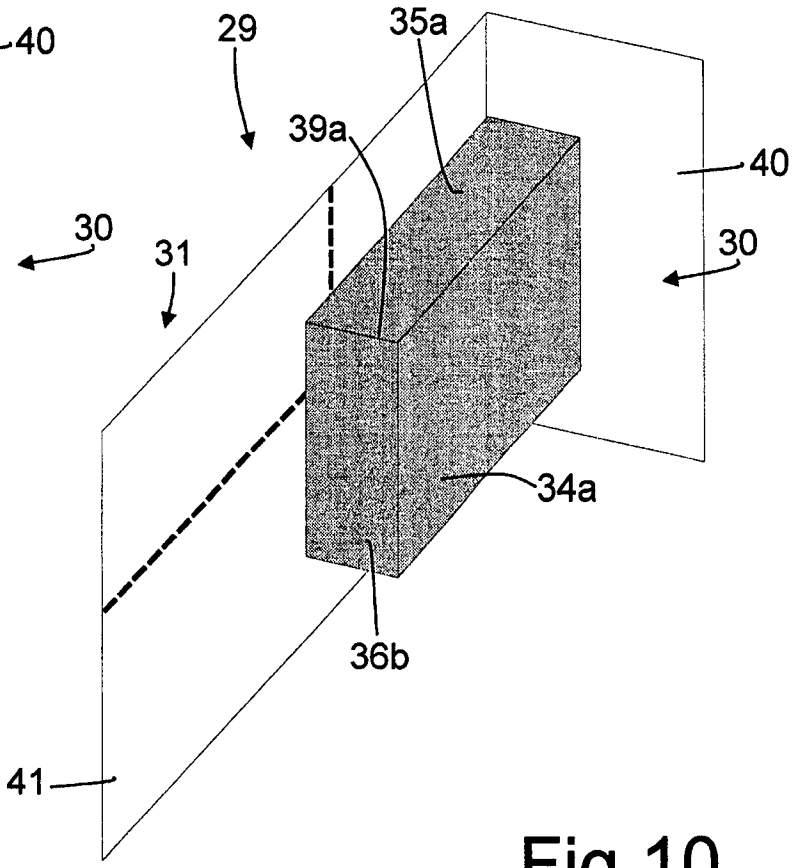
FIGS. 9-19 show views in perspective of a sequence of steps by which to fold the FIG. 7 sheet of inner wrapping material about the FIG. 8 group of cigarettes to form the FIG. 6 inner package.

As shown in FIGS. 6-8, inner package 2 is parallelepiped-shaped with a rectangular cross section, and is defined by a rectangular sheet 29 of foil inner wrapping material (shown spread out in FIG. 7) folded about an orderly, substantially parallelepiped-shaped group 30 of cigarettes (FIG. 8) with a rectangular cross section. Inner package 2 has a single tear-off top portion 31, which is bounded by a tear line 32, extends seamlessly over a single portion of sheet 29 of wrapping material (as shown in FIG. 7), and, when unsealing packet 1 of cigarettes, is torn off for easy access to group 30 of cigarettes. Tear-off top portion 31 preferably comprises a tab 33, which is pressed down onto a top wall of inner package 2, and can be lifted up and gripped by the user to tear tear-off top portion 31 off inner package 2. In other words, tab 33 is formed from and forms an integral part of tear-off top portion 31, and can be lifted up and gripped by the user to pull tear-off top portion 31 off inner package 2.

As shown in FIG. 7, sheet 29 of wrapping material is in the form of an elongated rectangle with two parallel, opposite long sides, and two parallel, opposite short sides.

As shown in FIG. 8, group 30 of cigarettes is substantially parallelepiped-shaped with a rectangular cross section, and comprises two parallel, opposite, rectangular major lateral walls 34 (only one shown in FIG. 8) defined by cylindrical lateral walls of the cigarettes; two parallel, opposite, rectangular minor lateral walls 35 (only one shown in FIG. 8) defined by cylindrical lateral walls of the cigarettes and smaller than major lateral walls 34; and two parallel, opposite, rectangular end walls 36 (only one shown in FIG. 8) defined by the flat ends of the cigarettes (more specifically, one end wall 36*a* is defined by the plain ends of the cigarettes, and the other end wall 36*b* is defined by the filter-tipped ends).

Four longitudinal edges 37 are defined between the two major lateral walls 34 and the two minor lateral walls 35; four major transverse edges 38 are defined between the two major lateral walls 34 and the two end walls 36; and four minor transverse edges 39 are defined between the two minor lateral walls 35 and the two end walls 36.

The way in which sheet 29 of wrapping material is folded about group 30 of cigarettes to form inner package 2 will now be described with reference to FIGS. 9-19.

Figure 9:
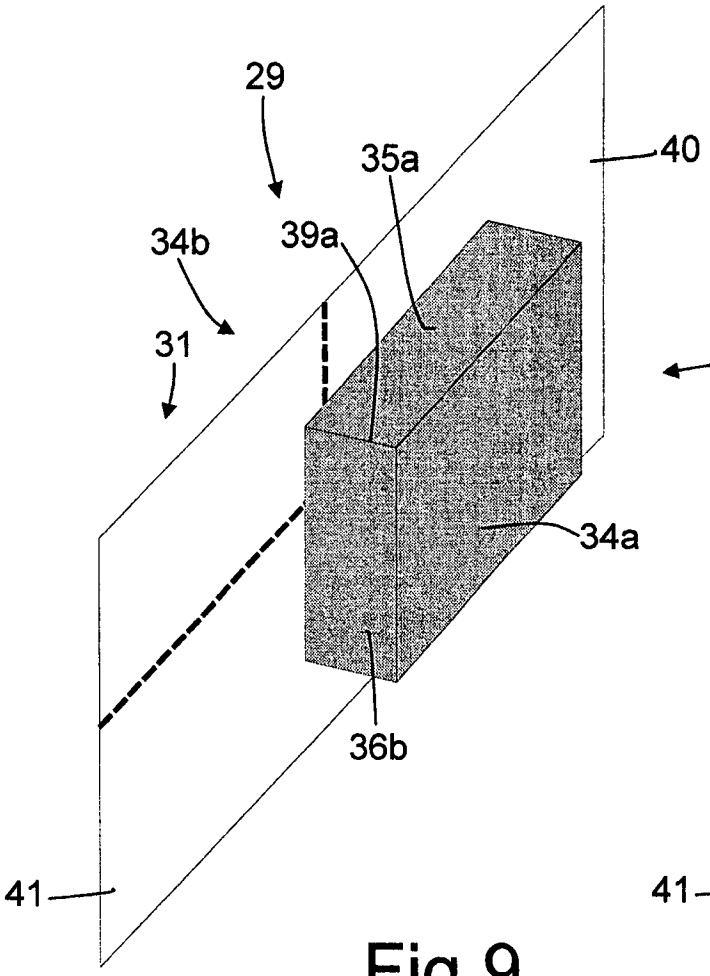
Figure 13:
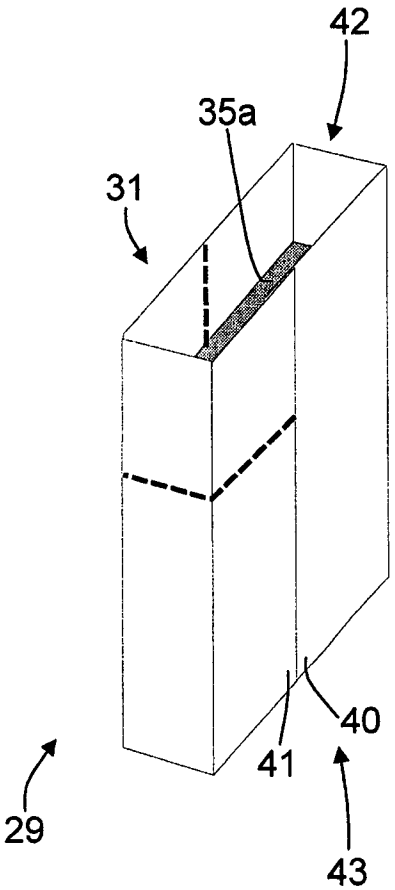
Figure 12:
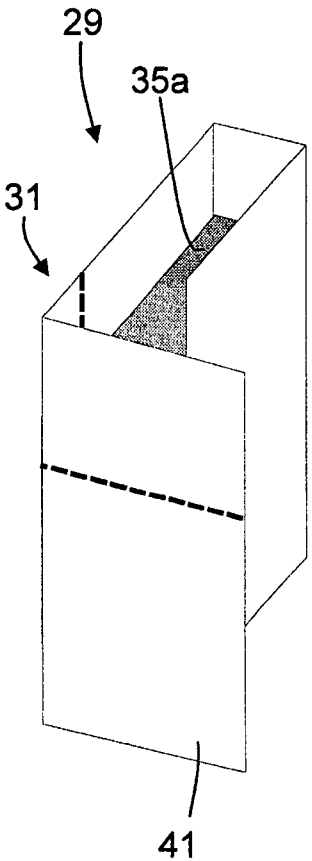
Figure 11:
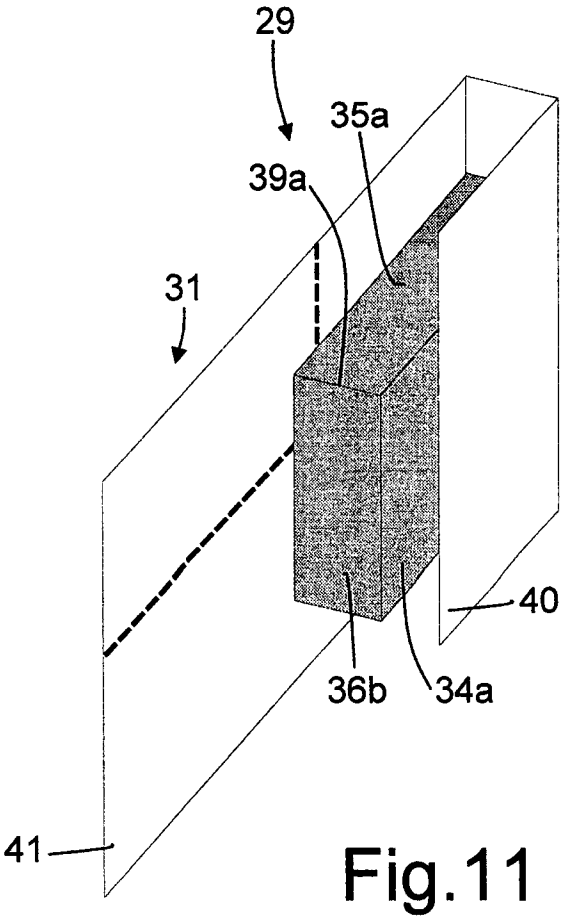
Figure 16:
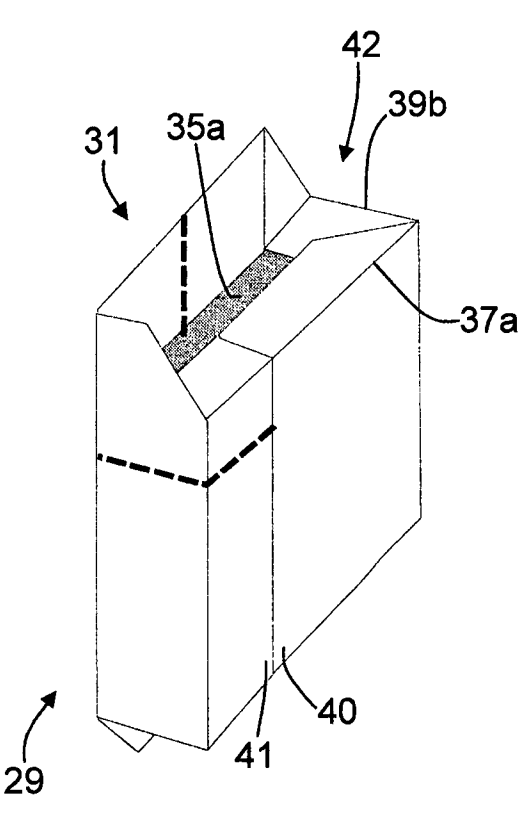
Figure 15:
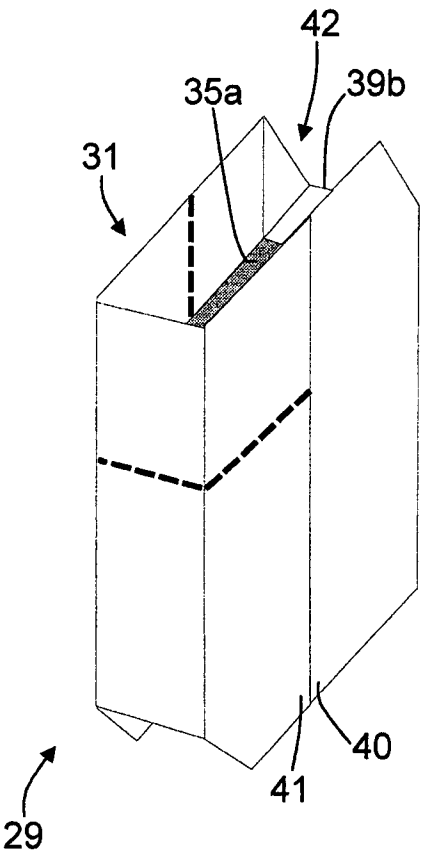
Figure 14:
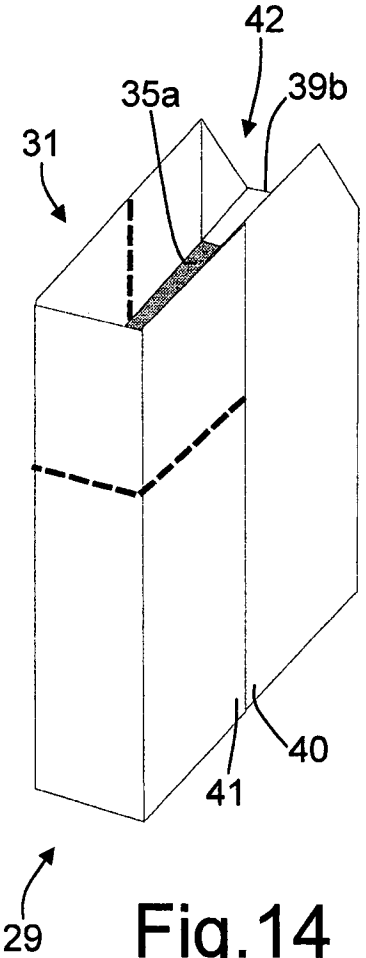
Figure 19:
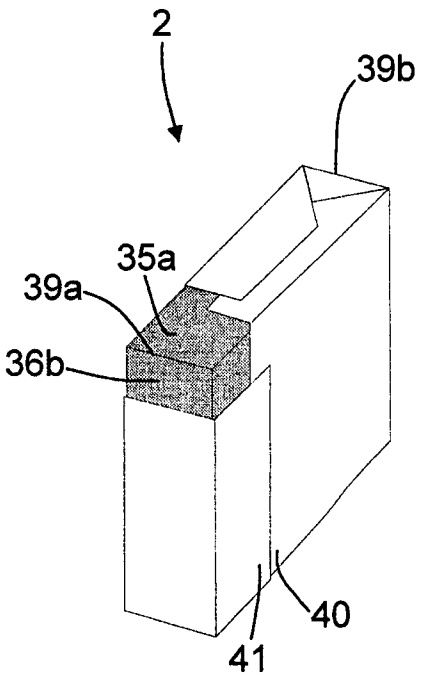

Firstly, as shown in FIG. 9, one major lateral wall 34*b* of group 30 of cigarettes is brought into contact with the spread-out sheet 29 of wrapping material, so that longitudinal edges 37 of group 30 of cigarettes are parallel to the long sides of sheet 29 of wrapping material, and major transverse edges 38 of group 30 of cigarettes are parallel to the short sides of sheet 29 of wrapping material. Major lateral wall 34*b* of group 30 of cigarettes is positioned symmetrically at the centre with respect to the long sides of sheet 29 of wrapping material, but asymmetrically with respect to the short sides of sheet 29 of wrapping material (more specifically, is positioned over the centreline, closer to tear-off top portion 31). Sheet 29 of wrapping material is then folded about group 30 of cigarettes, and two opposite flaps 40 and 41 of sheet 29 of wrapping material are overlapped to form a tubular wrapping (FIG. 13) enclosing group 30 of cigarettes and having two open lateral ends 42, 43 at the minor lateral walls 35 of group 30 of cigarettes. Opposite flaps 40 and 41 of sheet 29 of wrapping material overlap on the other major lateral wall 34*a* of group 30 of cigarettes, so that tear-off top portion 31 is located at a top quarter of inner package 2, as shown for example in FIG. 2.

Figure 17:
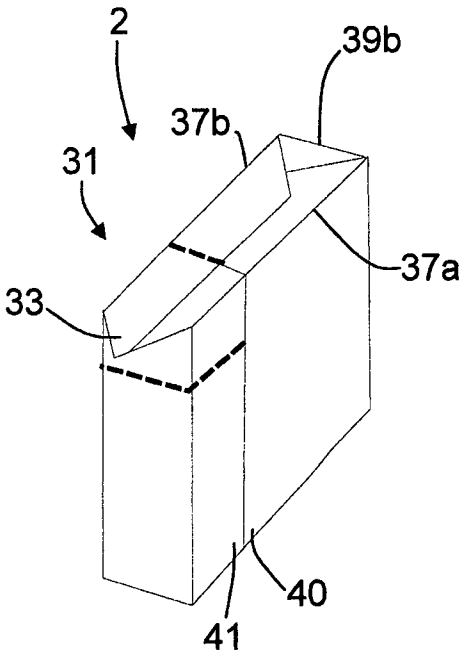

Finally (FIGS. 14-17), the open lateral ends 42, of sheet 29 of wrapping material are folded to complete inner package 2. More specifically, sheet 29 of wrapping material is folded about a minor transverse edge 39*a* of group 30 of cigarettes at tear-off top portion 31, to form, with part of tear-off top portion 31, tab 33 astride minor transverse edge 39*a* (as shown in FIG. 17).

To form tab 33, sheet 29 of wrapping material is folded, at open lateral end 42 involving tear-off top portion 31, about a longitudinal edge 37*a* onto a minor lateral wall 35*a*, without first being folded about minor transverse edge 39*a* (FIG. 16); and is then folded, at open lateral end 42, about a second longitudinal edge 37*b* onto minor lateral wall 35*a*. In a preferred embodiment, before being folded about longitudinal edge 37*a* onto minor lateral wall 35*a*, sheet 29 of wrapping material is folded about a minor transverse edge 39*b* of minor lateral wall 35*a*.

Open lateral end 43 is preferably folded by first folding sheet 29 of wrapping material about the two minor transverse edges 39, and then about the two longitudinal edges 37.

Figure 18:
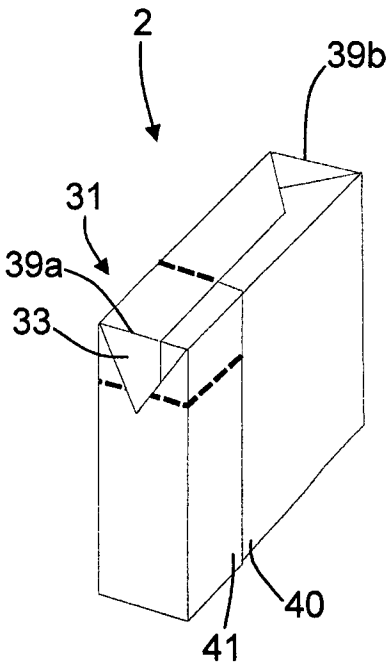
Figure 20:
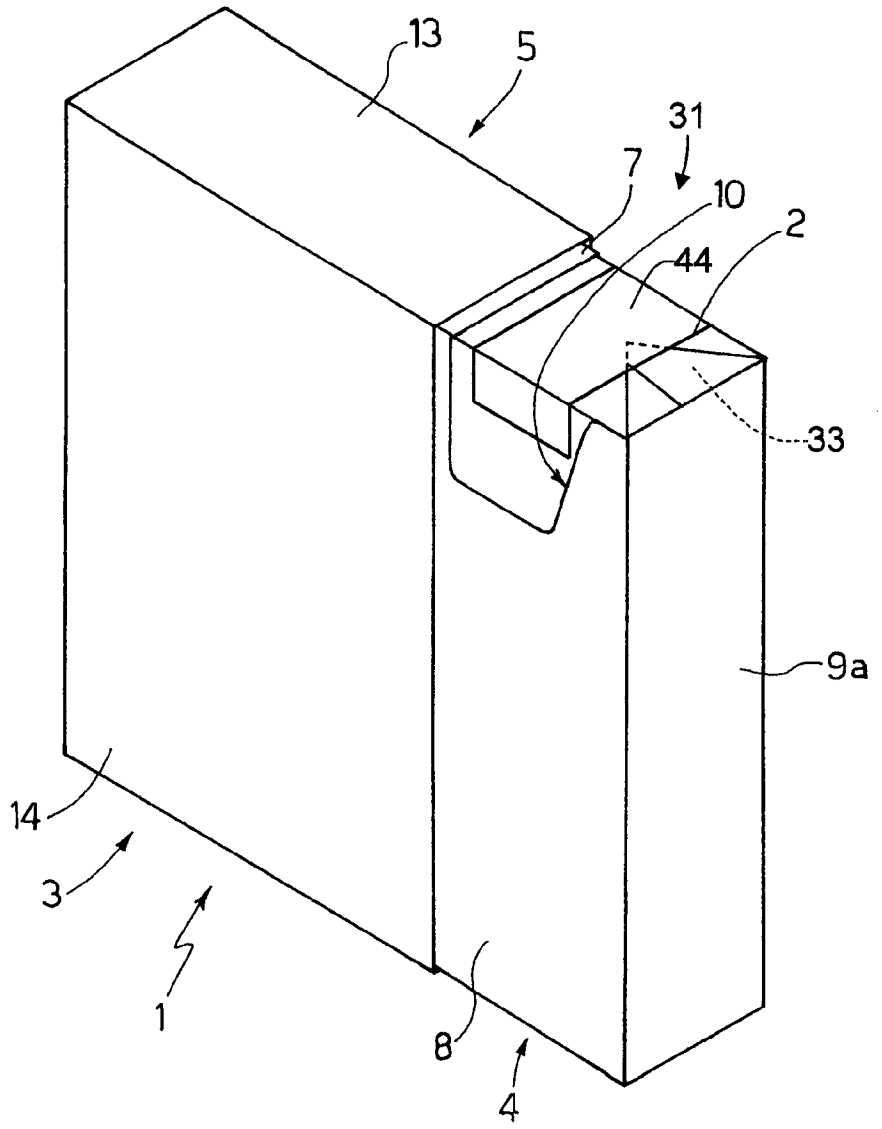
FIG. 20 shows a front view in perspective of a variation of the FIG. 1 packet of cigarettes in an open configuration.

As stated, tab 33 is folded about minor transverse edge 39*a* onto end wall 36*b* of group 30 of cigarettes (as shown in FIG. 18). In a preferred embodiment, tab 33 is fixed temporarily to the rest of tear-off top portion 31 covering end wall 36*b* of group 30 of cigarettes. This can be done by applying weak-stick glue (i.e. non-permanent glue that allows parts to be pulled apart easily) between tab 33 and the rest of tear-off top portion 31, to fix tab 33 temporarily to the rest of tear-off top portion 31; or by applying a tear-off sticker 44 (FIG. 20), coated with weak-stick glue (i.e. non-permanent glue that allows parts to be pulled apart easily), over tab 33 and the rest of tear-off top portion 31, to fix tab 33 temporarily to the rest of tear-off top portion 31. In one variation, tear-off sticker 44 is applied to tab 33 and the rest of tear-off top portion 31 using strong-stick glue (i.e. permanent glue that only allows parts to be ripped apart). In which case, both tear-off top portion 31 and tear-off sticker 44 can be removed simultaneously by the user. For easy removal, sticker 44 may be provided with a non-glued grip tab (not shown). Tear-off sticker 44 may also be glued over tab 33 and the rest of tear-off top portion 31 using strong-stick glue, to fix tab 33 permanently to the rest of tear-off top portion 31.

Figure 21:
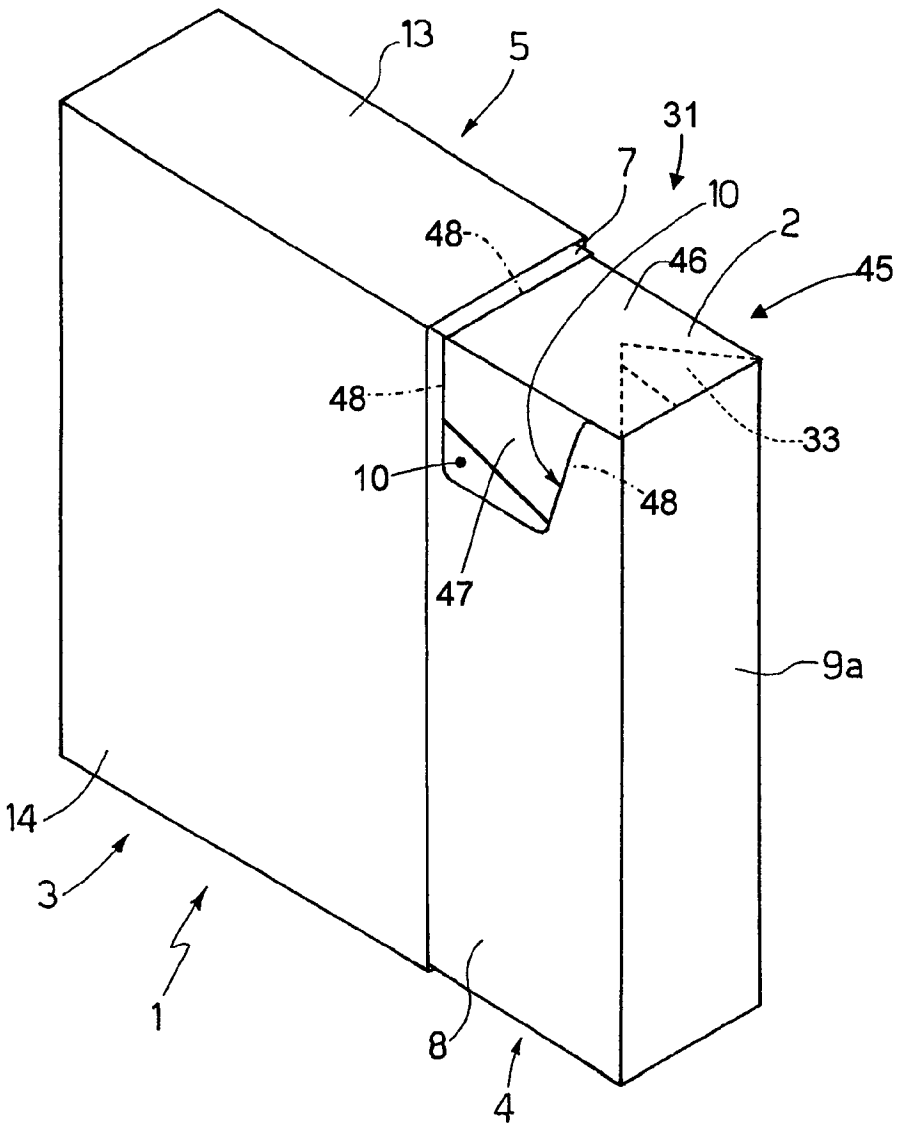
FIG. 21 shows a front view in perspective of a further variation of the FIG. 1 packet of cigarettes in an open configuration.

In the alternative embodiment shown in FIG. 21, outer package 3, in particular inner container 4 of outer package 3, comprises a tear-off lid 45, which is torn off when unsealing packet 1 of cigarettes, and at least partly covers extraction opening 10 of inner container 4 (and therefore almost the whole of tear-off top portion 31).

Tear-off lid 45 is U-shaped, and comprises a top wall 46 forming a natural extension of top wall 7 of inner container 4; and two lateral walls 47 coplanar with major lateral walls 8 of inner container 4. Tear-off lid 45 (i.e. top wall 46 and lateral walls 47 of tear-off lid 45) is connected to the rest of inner container 4 along tear lines 48. More specifically, top wall 46 of tear-off lid 45 is connected to top wall 7 of inner container 4 along a tear line 48; and each lateral wall 47 of tear-off lid 45 is connected to a respective major lateral wall 8 of inner container 4 along two tear lines 48 on opposite sides of lateral wall 47.

Figure 32:
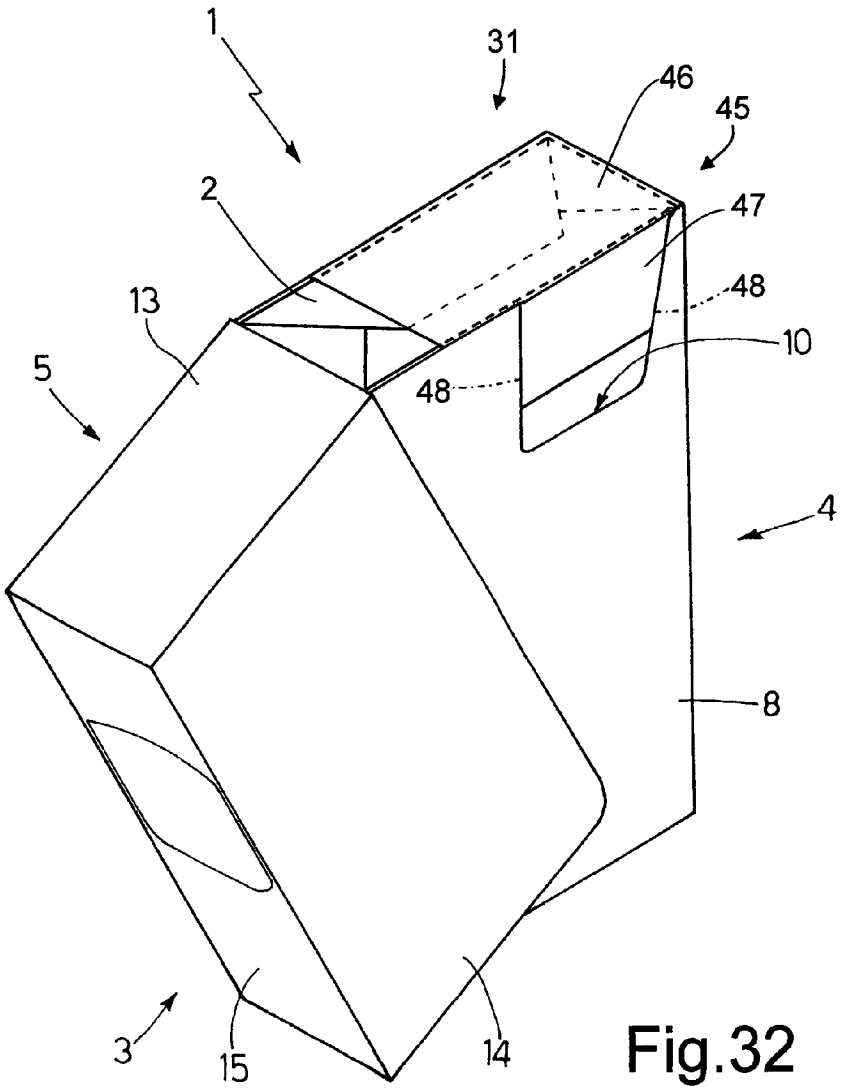
FIG. 32 shows a front view in perspective of the FIG. 31 packet of cigarettes in an open configuration.

In a preferred embodiment, as opposed to covering the whole of extraction opening 10, tear-off lid 45 leaves at least part of extraction opening 10 uncovered, to form a grip by which to grip and remove tear-off lid easily. Each part of extraction opening 10 left uncovered by tear-off lid 45 is preferably located on a respective major lateral wall 8 of inner container 4. Which means tear-off lid 45 may leave uncovered two separate parts of extraction opening 10, located symmetrically on the two major lateral walls 8 of inner container 4, or only one part of extraction opening 10, located asymmetrically on one major lateral wall 8 of inner container 4. Alternatively or in addition, top wall 46 of tear-off lid 45 is smaller than the top wall of inner package 2 (as shown in FIG. 32), so as to provide a further grip by which to grip and remove tear-off lid 45 easily.

Figure 22:
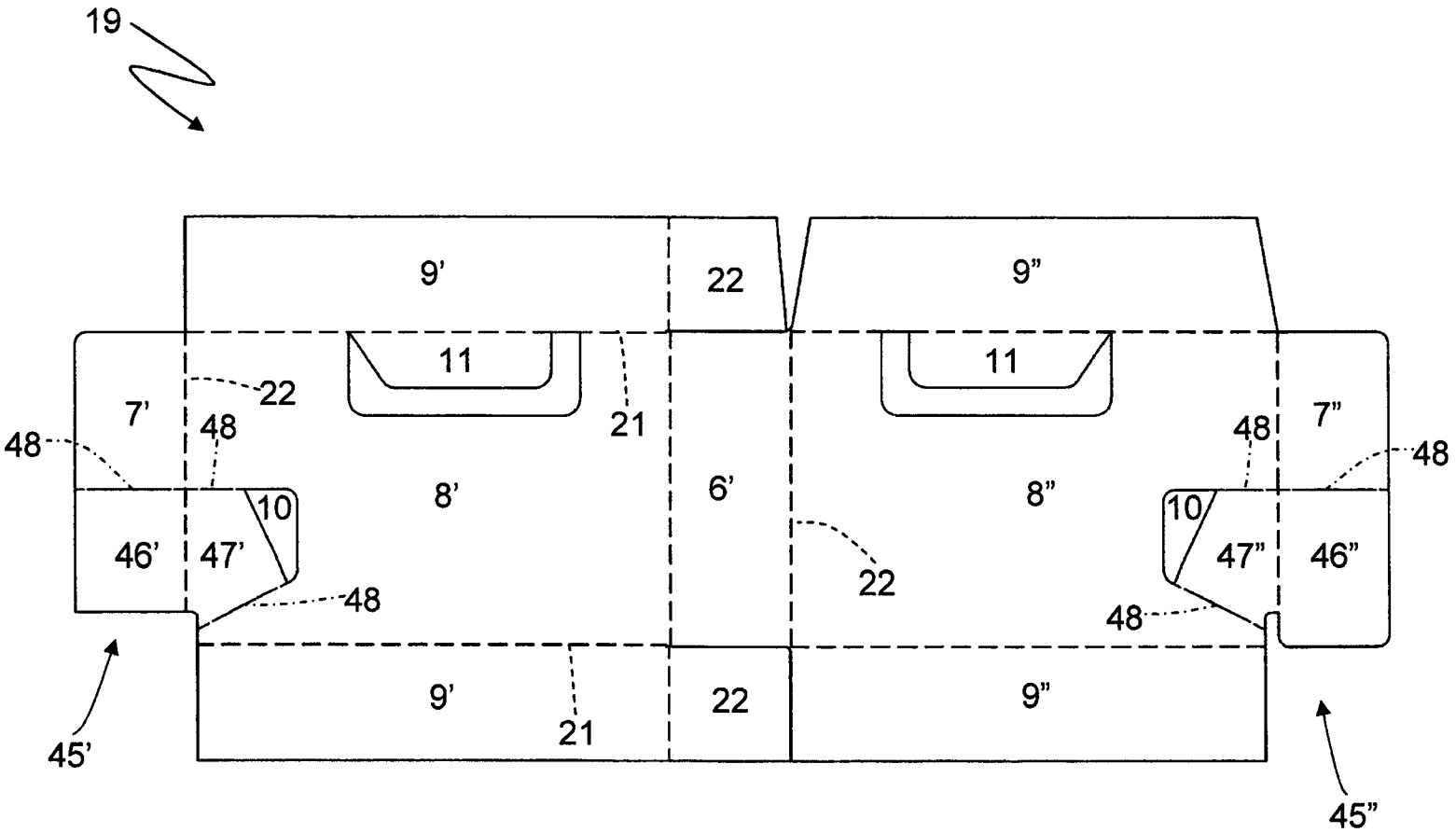
FIG. 22 shows a plan view of a variation of the FIG. 4 blank from which to form the inner container in FIG. 21.

As shown in FIG. 22, tear-off lid 45 is formed by superimposing and gluing together two separate panels 45' and 45". Panel 45' comprises two portions 46', 47' separated by a transverse fold line 22; panel 45" comprises two portions 46", 47" separated by a transverse fold line 22; and portion 46' of panel 45' is superimposed on and glued to portion 46" of panel 45" to form top wall 46 of lid 45.

Tear-off lid 45 also serves to keep tab 33 pressed down onto the rest of tear-off top portion 31 covering end wall 36*b* of group 30 of cigarettes. In one embodiment, tear-off lid 45 is glued to tear-off top portion 31 of inner package 2 (i.e. a bottom surface of tear-off lid 45 is glued to tear-off top portion 31) using strong-stick glue (i.e. permanent glue that only allows parts to be ripped apart), so that both tear-off top portion 31 and tear-off lid 45 can be removed simultaneously by the user.

Figure 23A:
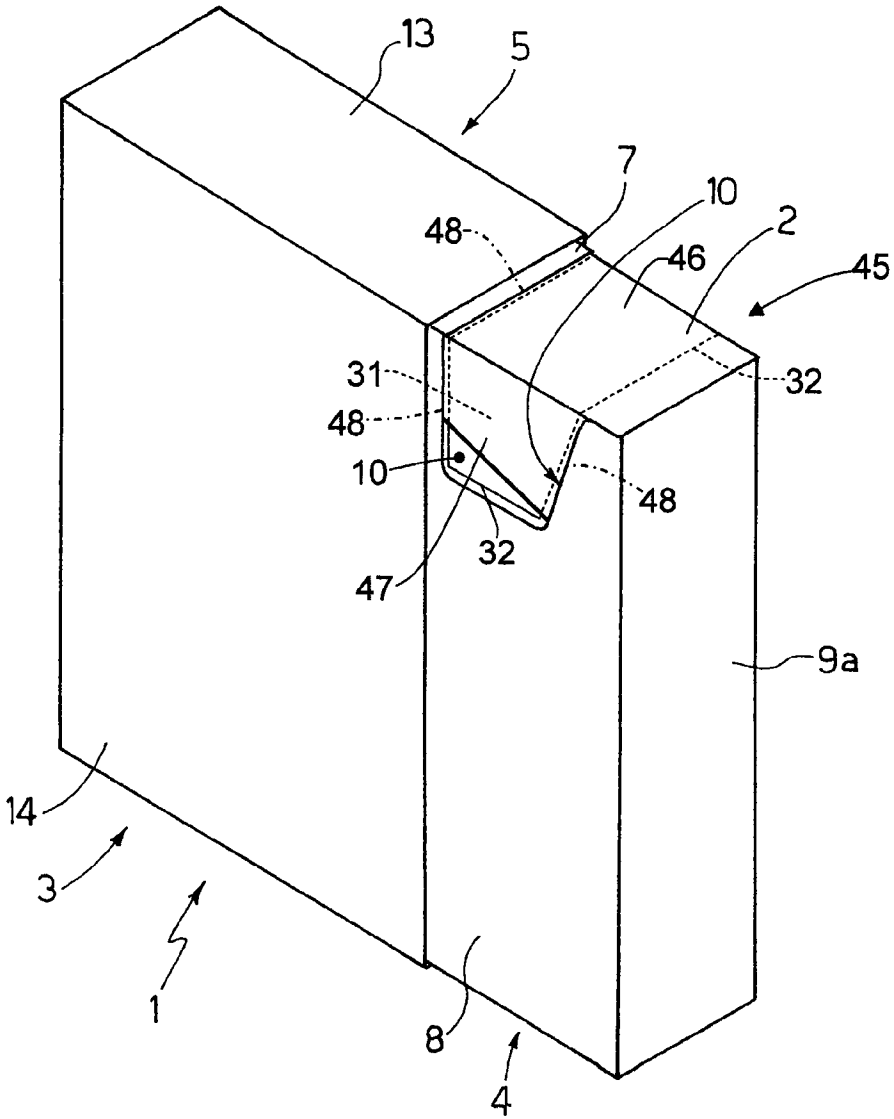
FIGS. 23*a* and 23*b* show front views in perspective of a further variation of the FIG. 1 packet of cigarettes in an open configuration, and respectively with and without a tear-off lid covering a top wall of an inner package.

The FIG. 23 embodiment differs from the FIG. 1-22 embodiments (particularly the FIG. 21 embodiment) as regards the form of tear-off top portion 31 and the way in which sheet 29 of inner wrapping material is folded about group 30 of cigarettes. In the FIG. 23 embodiment, tear-off top portion 31 involves an inner portion of sheet 29 of wrapping material; and sheet 29 of wrapping material is folded without forming tab 33. Comparison of sheets 29 of wrapping material in FIGS. 6 and 25, and of inner packages 2 in FIGS. 18 and 24 clearly shows the differences between the FIG. 23 and FIG. 1-22 embodiments.

Figure 23B:
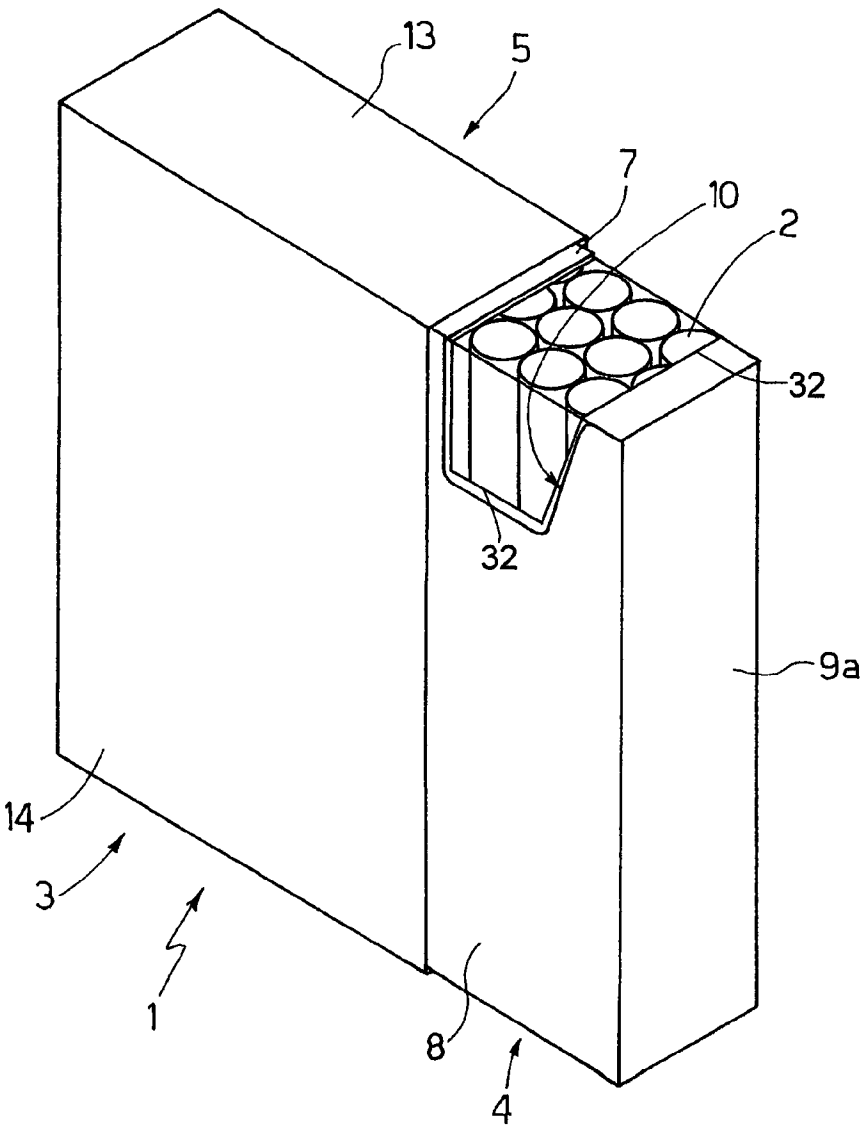
Figure 24:
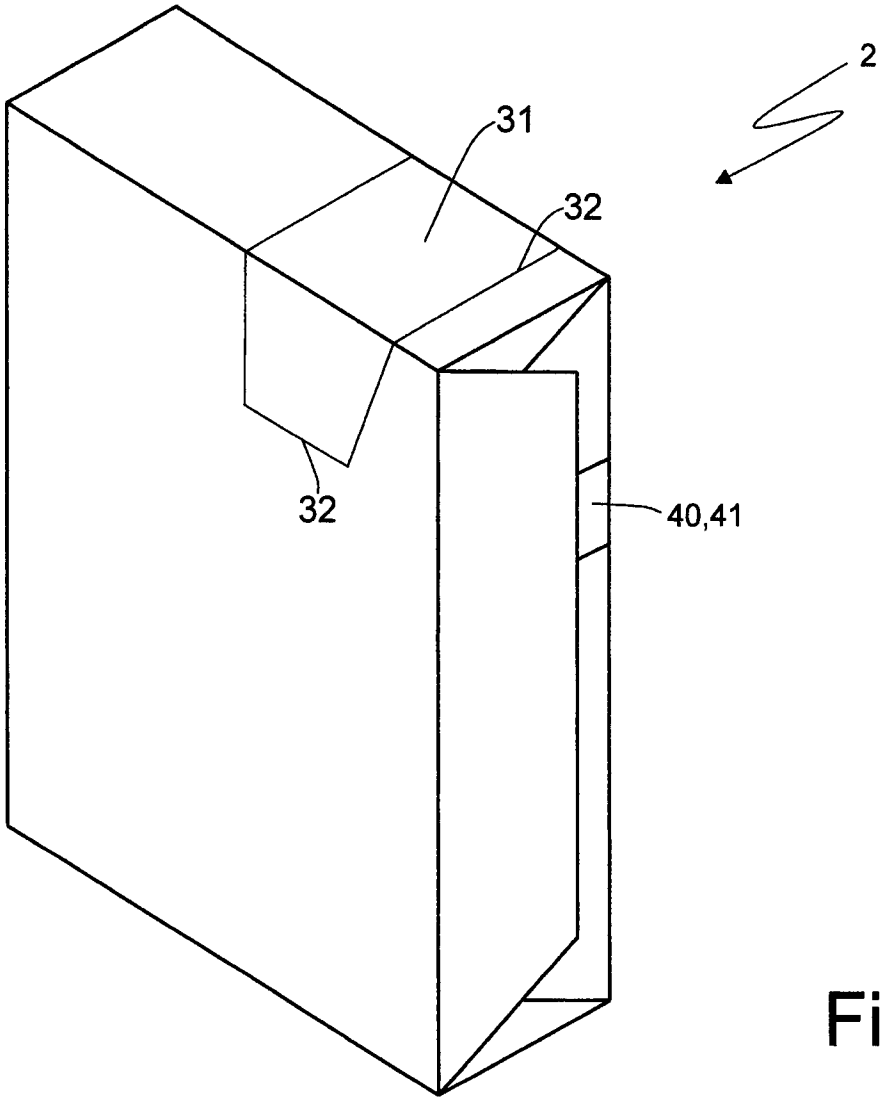
FIG. 24 shows a front view in perspective of an inner package of the FIG. 23 packet of cigarettes.
Figure 25:
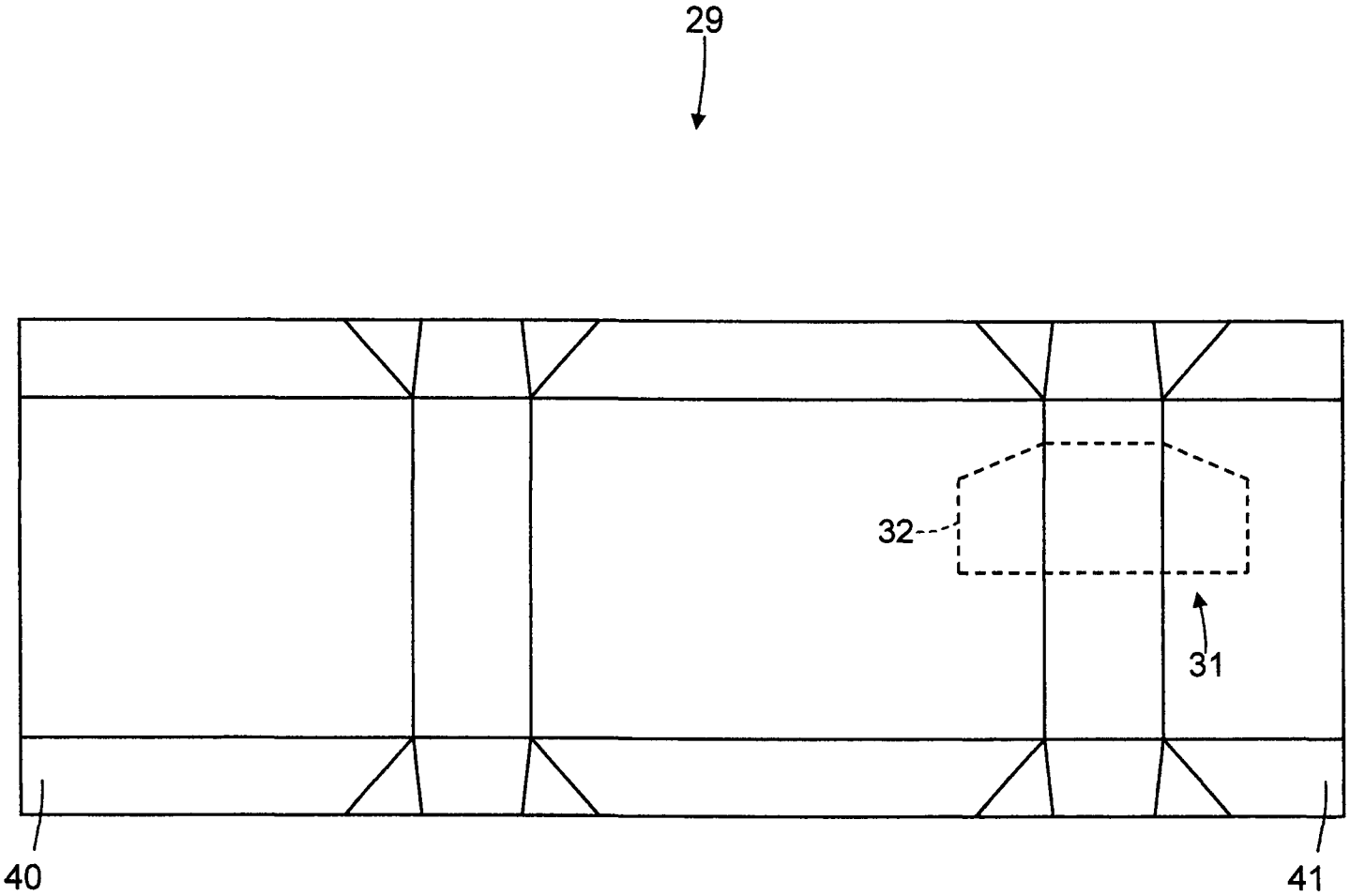
FIG. 25 shows a plan view of a sheet of inner wrapping material from which to form the FIG. 24 inner package.

It is important to note that, in the FIG. 23 embodiment too, sheet 29 of wrapping material is folded about group 30 of cigarettes by superimposing flaps 40 and 41 on major lateral wall 34*a* of group 30 of cigarettes, so that tear-off top portion 31 is located at a top quarter of inner package 2, as shown in FIG. 24.

In the FIG. 23 embodiment (as in the FIG. 21 embodiment), tear-off lid 45 is glued using strong-stick glue (or heat sealed) to tear-off top portion 31 of inner package 2, so that tear-off top portion 31 and tear-off lid 45 can be removed simultaneously by the user. (FIG. 23*b* shows packet 1 of cigarettes, from which tear-off lid 45 has been removed together with tear-off top portion 31, to expose the cigarettes in group 30 inside inner package 2). In one variation, tear-off lid 45 in the FIG. 23 embodiment is replaced with a tear-off sticker 44 (as in the FIG. 20 embodiment) glued with strong-stick glue (or heat sealed) to tear-off top portion 31 of inner package 2.

It is important to note that, in packet 1 of cigarettes (and its variations) described above, tear-off top portion 31 can be removed quickly and easily in one go, and no glue is present inside inner package 2. The latter is a potentially important feature, in that some types of glue are thought to negatively affect the organoleptic characteristics of the cigarettes if placed too close to them.

Figure 26:
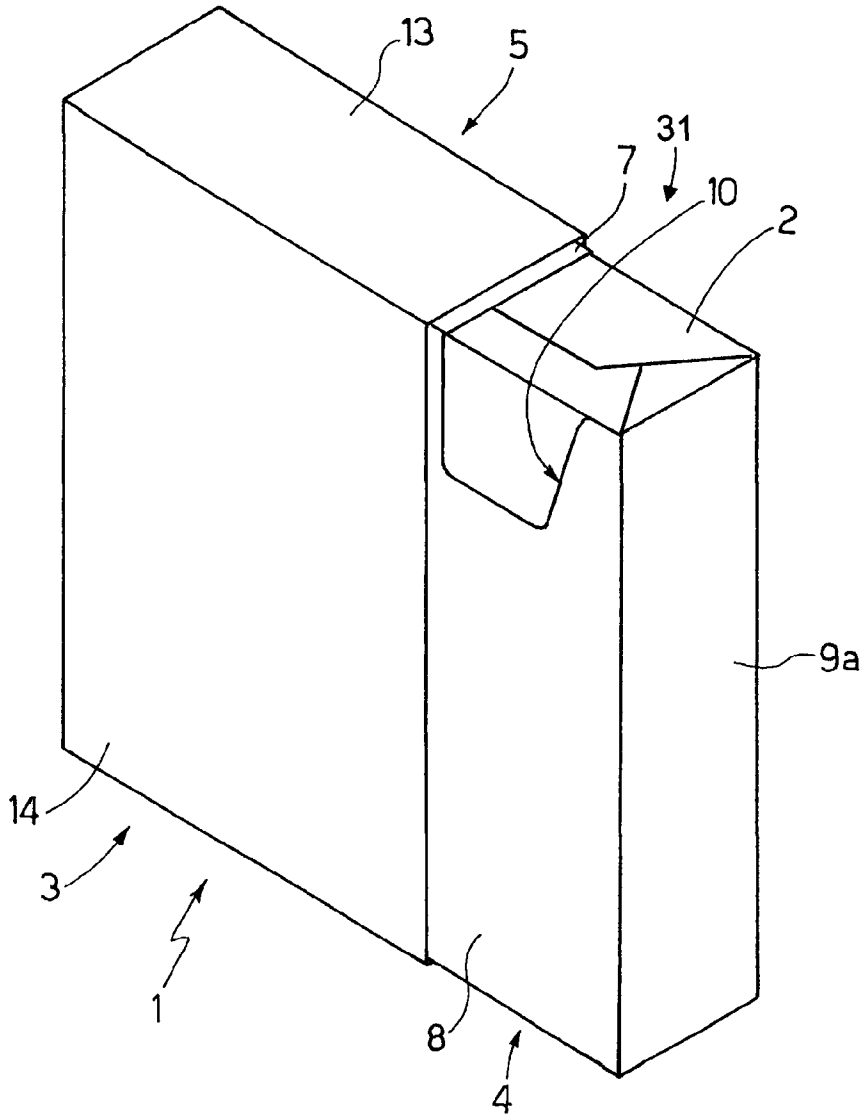
FIG. 26 shows a front view in perspective of a further variation of the FIG. 1 packet of cigarettes in an open configuration.
Figure 27:
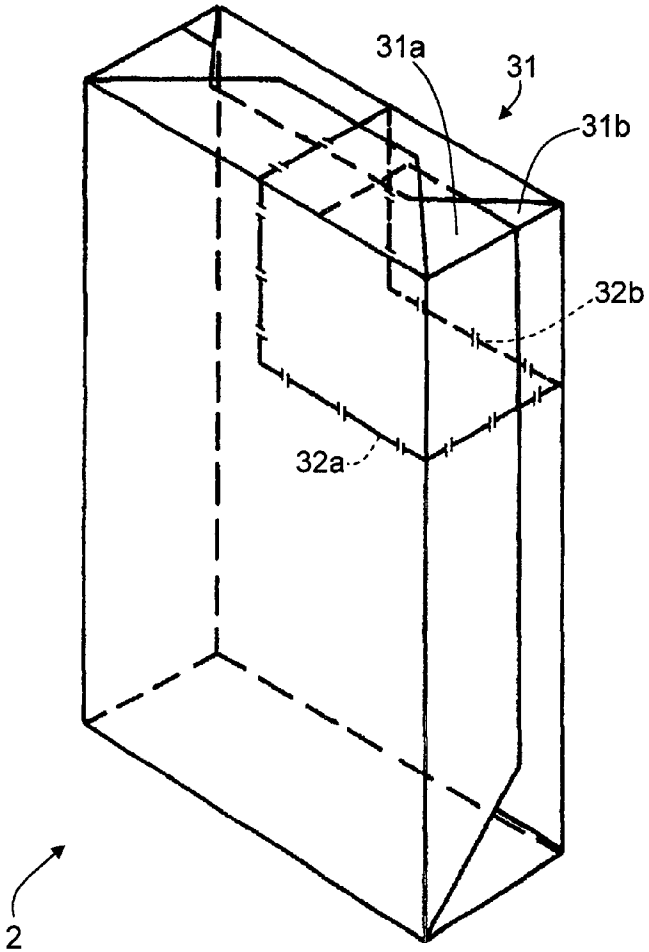
FIG. 27 shows a front view in perspective of an inner package of the FIG. 26 packet of cigarettes.
Figure 28:
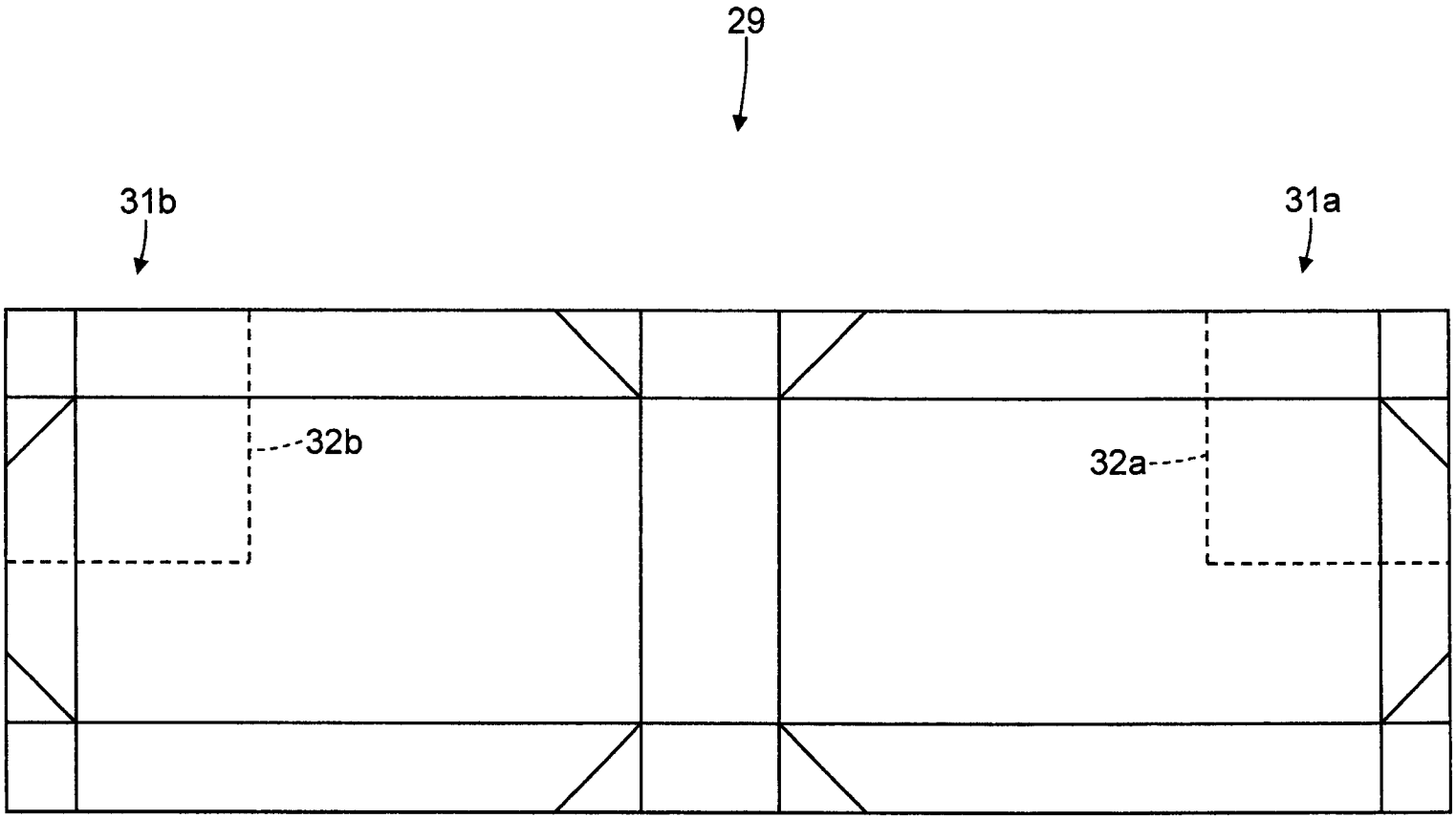
FIG. 28 shows a plan view of a sheet of inner wrapping material from which to form the FIG. 27 inner package.

In the alternative embodiment shown in FIGS. 26-28, sheet 29 of wrapping material (FIG. 28) has two tear lines 32*a*, 32*b* defining respective tear-off top portions 31*a*, 31*b* located at opposite edges of sheet 29 of wrapping material, and which overlap (as shown in FIG. 27) when sheet 29 of wrapping material is folded in known manner about group 30 of cigarettes to form inner package 2. Tear-off top portions 31*a*, 31*b* are glued integrally to one another using strong-stick glue, so that removal of either one also removes the other, thus enabling both tear-off top portions 31*a*, 31*b* to be removed in one go.

In the FIG. 26 embodiment, outer package 3 has no tear-off lid 45. In the FIG. 29 variation, outer package 3 has a tear-off lid 45 partly covering tear-off top portions 31*a*, 31*b*, and which may be separate from (i.e. not glued to) tear-off top portions 31*a*, 31*b*, may be glued with strong-stick glue to only one of tear-off top portions 31*a*, 31*b* (in which case, tear-off top portions 31*a*, 31*b* must be glued to each other with strong-stick glue), or may be glued with strong-stick glue to both tear-off top portions 31*a*, 31*b* (in which case, tear-off top portions 31*a*, 31*b* may either be glued to each other with strong-stick glue, or not glued at all). When tear-off lid 45 is glued with strong-stick glue to at least one of tear-off top portions 31*a*, 31*b*, both tear-off lid 45 and tear-off top portions 31*a*, 31*b* can be removed simultaneously by the user.

Figure 29:
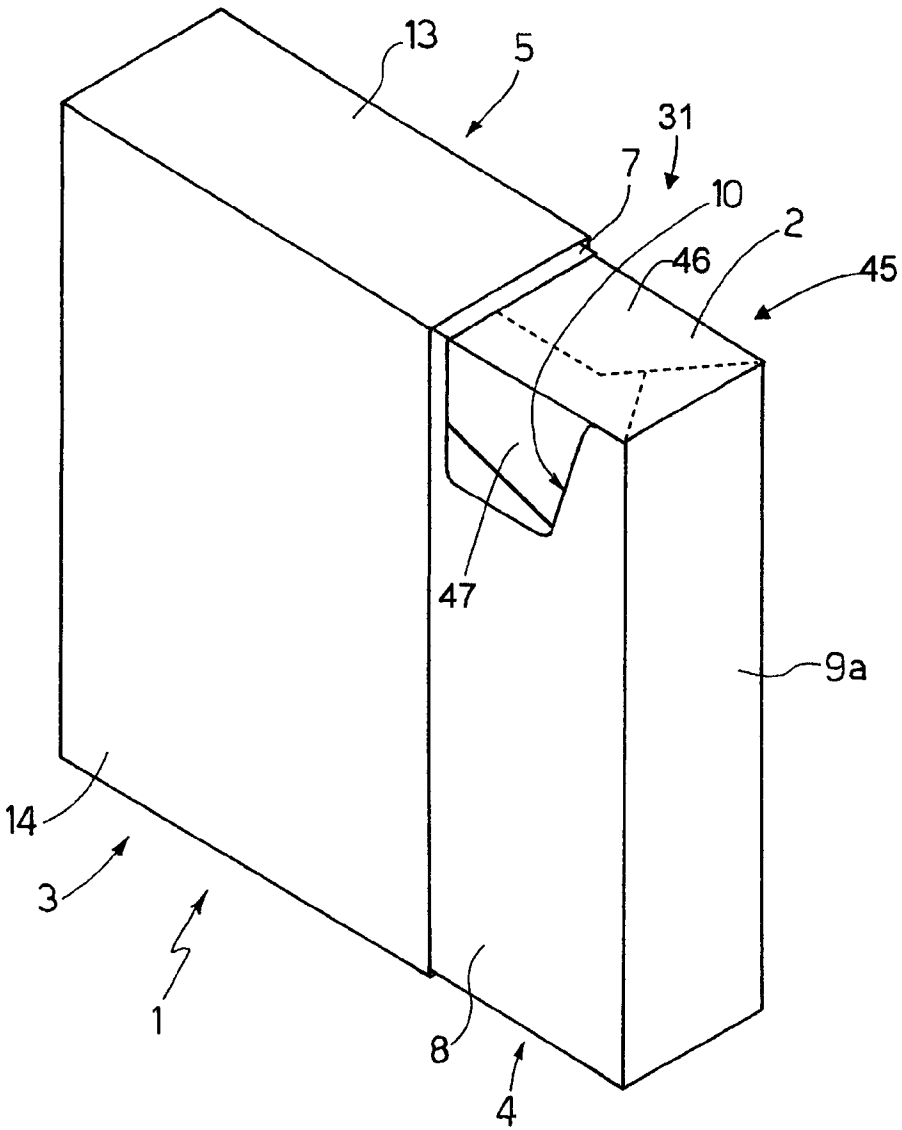
FIG. 29 shows a front view in perspective of a further variation of the FIG. 1 packet of cigarettes in an open configuration.
Figure 30:
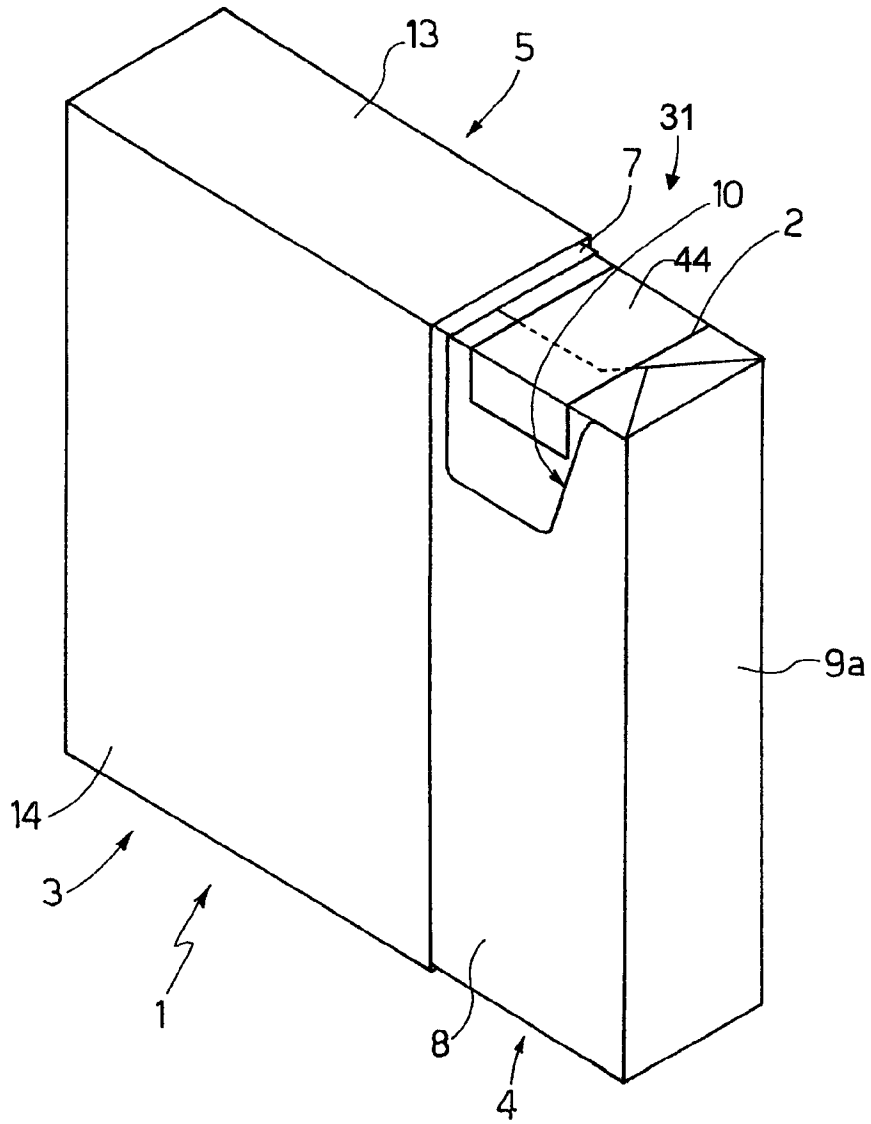
FIG. 30 shows a front view in perspective of a further variation of the FIG. 1 packet of cigarettes in an open configuration.

In the FIG. 29 embodiment, outer package 3 has a tear-off lid 45 partly covering tear-off top portions 31*a*, 31*b*. In the FIG. 30 variation, tear-off lid 45 is replaced with a tear-off sticker 44 glued using strong-stick glue (i.e. permanent glue that only allows parts to be ripped apart) to at least one tear-off top portion 31*a*, 31*b*. More specifically, tear-off sticker 44 may be glued with strong-stick glue to only one of tear-off top portions 31*a*, 31*b* (in which case, tear-off top portions 31*a*, 31*b* must be glued to each other with strong-stick glue), or may be glued with strong-stick glue to both tear-off top portions 31*a*, 31*b* (in which case, tear-off top portions 31*a*, 31*b* may either be glued to each other with strong-stick glue, or not glued at all). In this embodiment, both tear-off sticker 44 and tear-off top portions 31*a*, 31*b* can be removed simultaneously by the user.

Figure 31:
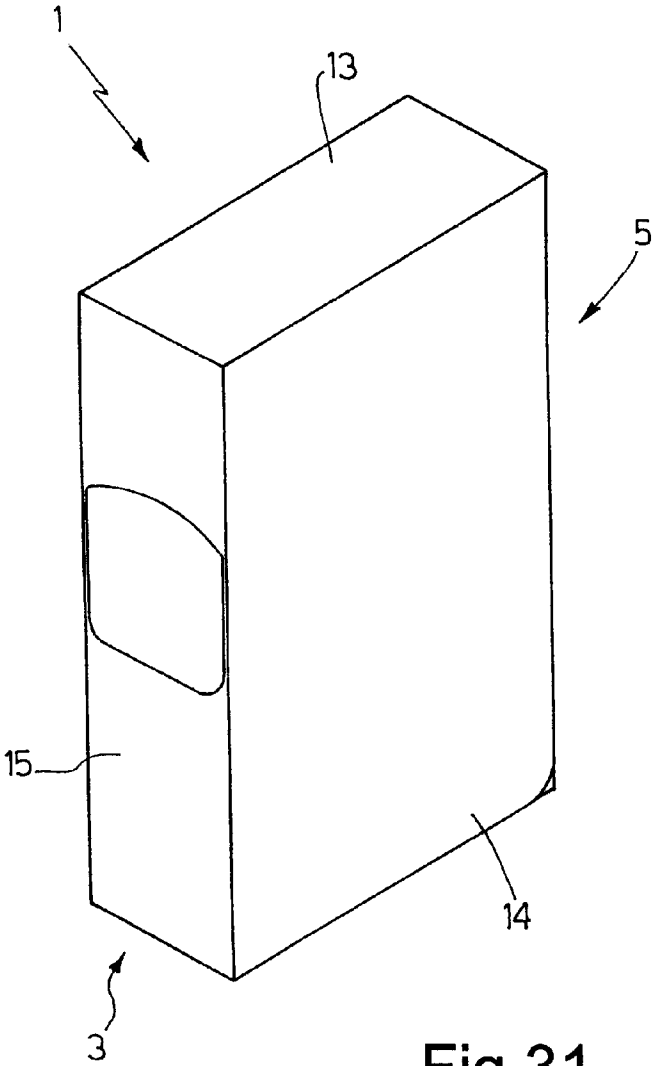
FIG. 31 shows a front view in perspective of a rigid, swing-open packet of cigarettes in a closed configuration.

The packet 1 of cigarettes in FIGS. 31 and 32 differs from the one in FIGS. 1 and 2 substantially as regards the way in which inner container 4 moves with respect to outer container 5: in packet 1 of cigarettes in FIGS. 1 and 2, inner container 4 translates with respect to outer container 5, whereas, in the packet 1 of cigarettes in FIGS. 31 and 32, inner container 4 rotates with respect to outer container 5.

Given the close resemblance between packet 1 of cigarettes in FIGS. 31 and 32, and the one in FIGS. 1 and 2, for a detailed description of the FIGS. 31 and 32 packet 1 of cigarettes, the reader is referred to the above description of packet 1 of cigarettes in FIGS. 1 and 2.

In the packet 1 of cigarettes in FIGS. 31 and 32, outer package 3, and more specifically inner container 4 of outer package 3, comprises a tear-off lid 45 (FIG. 32), which must be removed when unsealing packet 1 of cigarettes, and covers at least part of extraction opening 10 of inner container 4 (and therefore a top wall of inner package 2). Preferably, tear-off lid 45 covers the tear-off top portion 31 of inner package 2 forming a portion of the top wall of inner package 2. It is important to note that tear-off top portion 31 of inner package 2 may be formed as described above (i.e. by a seamless single portion of sheet 29 of wrapping material, as shown clearly in FIG. 7, with or without tab 33), or may be a conventional type, i.e. defined by two separate overlapping portions 31*a*, 31*b* of sheet 29 of wrapping material (as shown in FIGS. 27 and 28). In which case, the two separate portions 31*a*, 31*b* forming tear-off top portion 31 of inner package 2 may or may not be glued to each other.

Figure 33:
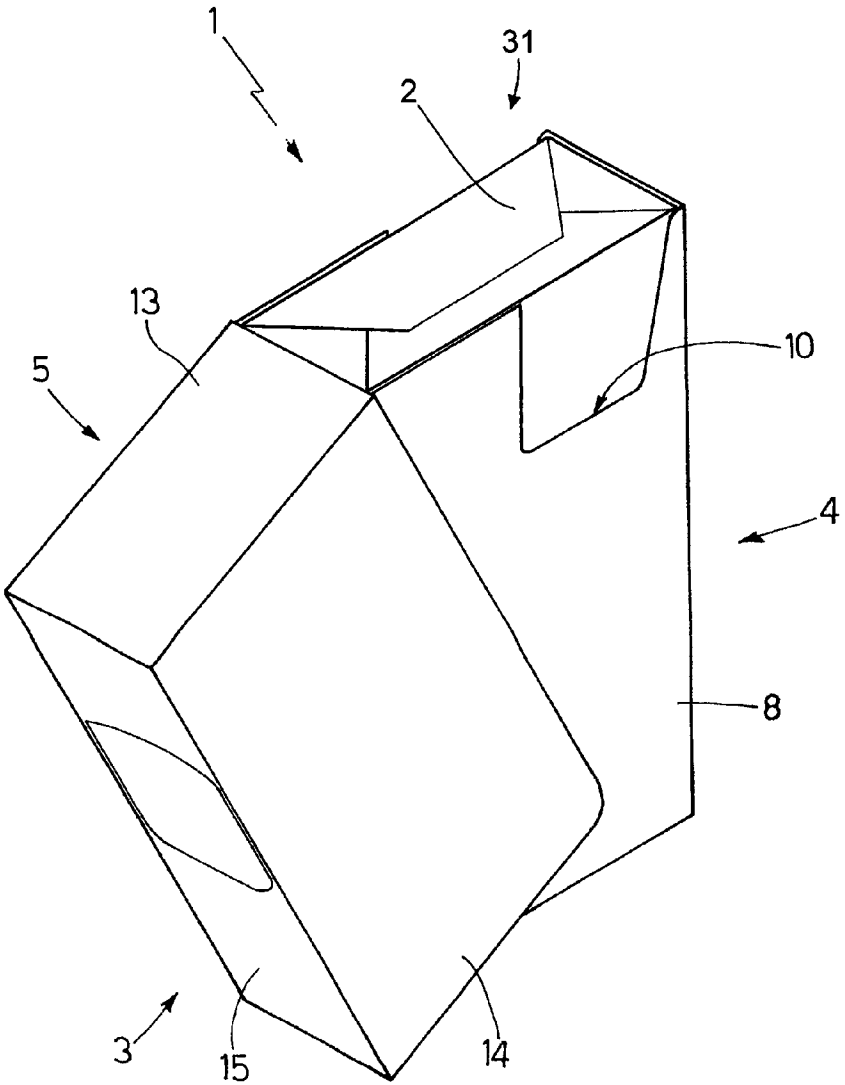
FIG. 33 shows a front view in perspective of the FIG. 31 packet of cigarettes in an open configuration, and with a tear-off lid, which covers a top wall of an inner package, removed.

FIG. 33 shows packet 1 of cigarettes with tear-off lid 45 removed from inner container 4, and clearly showing the whole top wall of inner package 2 in which tear-off top portion 31 is formed.

In the FIG. 31-33 embodiment, inner container 4 has no top wall 7 at all, so that, once tear-off lid 45 is removed from inner container 4, the top wall of inner package 2 is completely exposed (as shown in FIG. 33).

Tear-off lid 45 is U-shaped, and comprises a top wall 46 covering the top wall of inner package 2 (and which would form a natural extension of top wall 7 of inner container 4 if it had one); and two lateral walls 47 covering part of the major lateral walls of inner package 2, and coplanar with major lateral walls 8 of inner container 4. Tear-off lid 45 (i.e. top wall 46 and lateral walls 47 of tear-off lid 45) is connected to the rest of inner container 4 along tear lines 48. More specifically, top wall 46 of tear-off lid 45 is not connected to inner container 4; and each lateral wall 47 of tear-off lid 45 is connected to a respective major lateral wall 8 of inner container 4 along a single U-shaped tear line 48 (as shown in blank 19 in FIG. 34), or along two tear lines 48 on opposite sides of lateral wall 47.

In a preferred embodiment, as opposed to covering the whole of extraction opening 10, tear-off lid 45 leaves at least part of extraction opening 10 uncovered, to form a grip by which to grip and remove tear-off lid easily. Each part of extraction opening 10 left uncovered by tear-off lid 45 is preferably located on a respective major lateral wall 8 of inner container 4. Which means tear-off lid 45 may leave uncovered two separate parts of extraction opening 10, located symmetrically on the two major lateral walls 8 of inner container 4, or only one part of extraction opening 10, located asymmetrically on one major lateral wall 8 of inner container 4 (as in blank 19 in FIG. 34).

Figure 34:
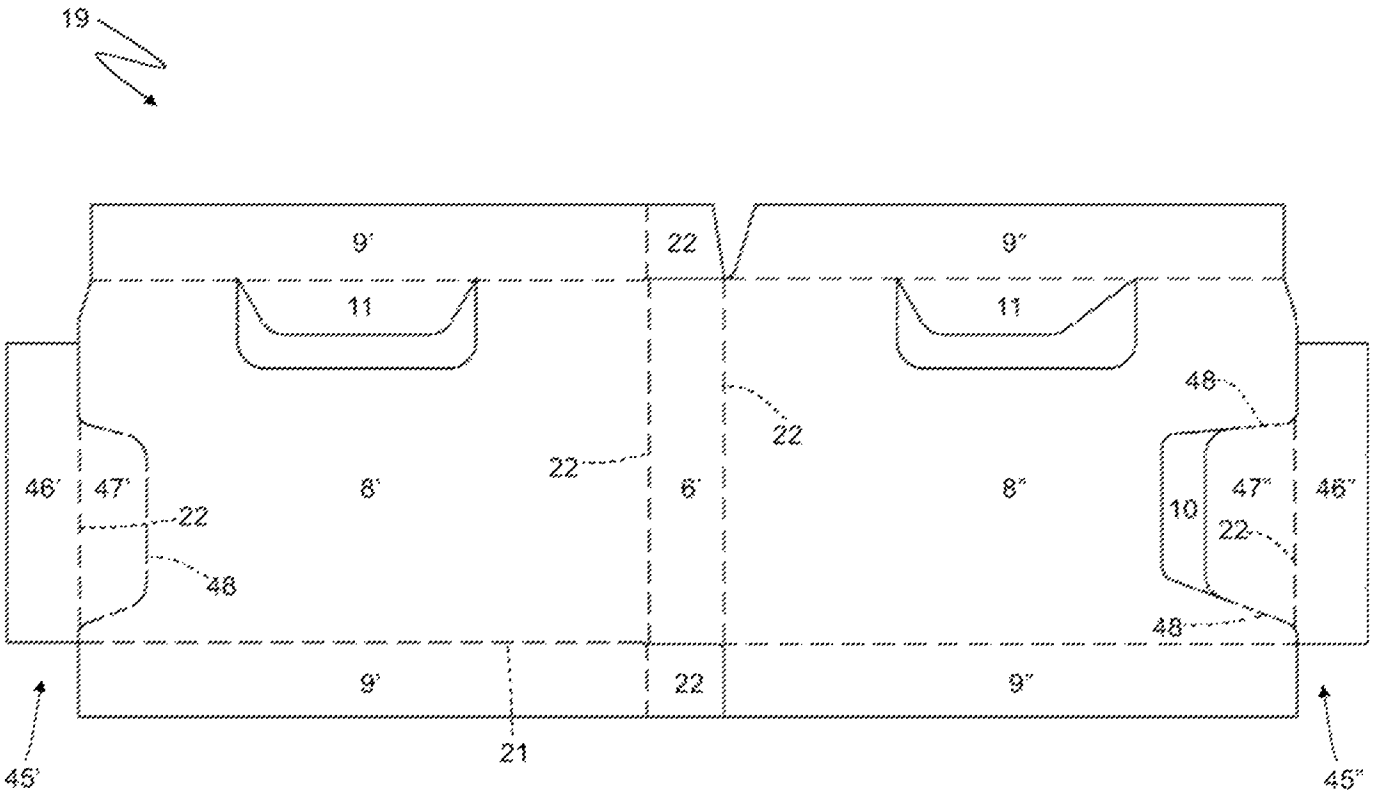
FIG. 34 shows a plan view of a blank from which to form an inner container of the FIG. 31 packet of cigarettes.

As shown in blank 19 in FIG. 34, tear-off lid 45 is formed by superimposing and gluing together two separate panels 45' and 45". Panel 45' comprises two portions 46', 47' separated by a transverse fold line 22; panel 45" comprises two portions 46", 47" separated by a transverse fold line 22; and portion 46' of panel 45' is superimposed on and glued to portion 46" of panel 45" to form top wall 46 of lid 45.

In a preferred embodiment, tear-off lid 45 is in no way fixed (glued) to tear-off top portion 31 of inner package 2, which means, once tear-off lid 45 is removed, the underlying tear-off top portion 31 of inner package remains whole (as shown in FIG. 33). In an alternative embodiment, tear-off lid 45 is glued to tear-off top portion 31 of inner package 2 (i.e. a bottom surface of tear-off lid 45 is glued to tear-off top portion 31) using strong-stick glue (i.e. permanent glue that only allows parts to be ripped apart), so that both tear-off top portion 31 and tear-off lid 45 can be removed simultaneously by the user.

Tear-off lid 45 keeps tear-off top portion 31 of inner package 2 pressed down onto the top wall of inner package 2, thus preventing parts of tear-off top portion 31 from lifting off the rest of inner package 2 and jamming against the inner surface of outer container 5, thus making it difficult (if not impossible, without tearing the wrapping material) to unseal packet 1 of cigarettes. (This problem only applies when unsealing packet 1 of cigarettes, in that, once unsealed, tear-off top portion 31 has been removed).

FIG. 34 shows the blank 19 from which to form the inner container 4 of packet 1 of cigarettes in FIGS. 31-33. Blank 19 in FIG. 34 is identical to blank 19 in FIG. 4—to the description of which the reader is therefore referred for a detailed description of blank in FIG. 34—except, obviously, for comprising panels 45' and 45" from which to form tear-off lid 45.

Figure 35:
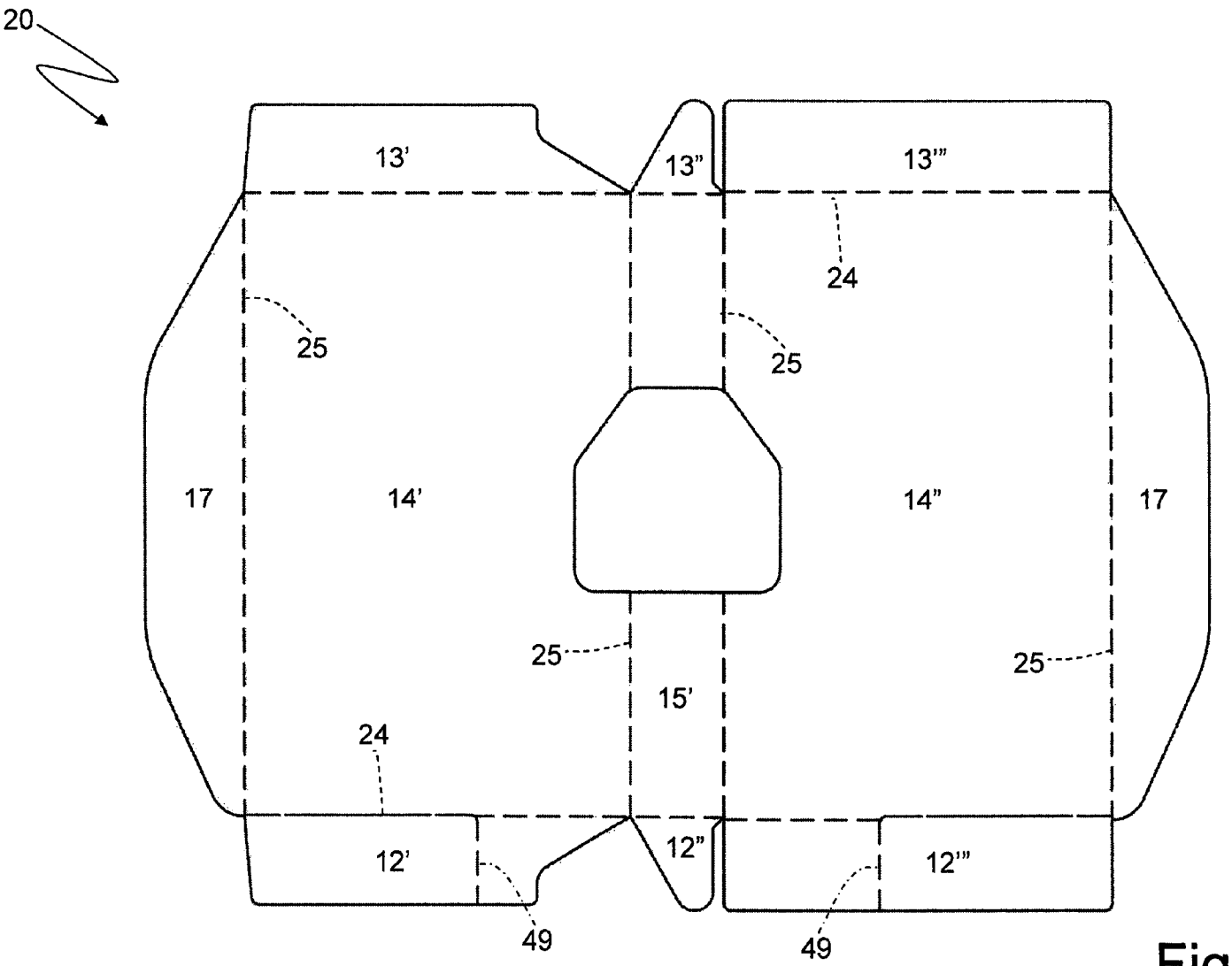
FIG. 35 shows a plan view of a blank from which to form an outer container of the FIG. 31 packet of cigarettes.

FIG. 35 shows the blank 20 from which to form the outer container 5 of packet 1 of cigarettes in FIGS. 31-33. Blank 20 in FIG. 35 is identical to blank 20 in FIG. 5—to the description of which the reader is therefore referred for a detailed description of blank in FIG. 35—except for wings 12' and 12'" comprising the fold lines defining hinge 49 about which inner container 4 rotates with respect to outer container 5.

Figure 36:
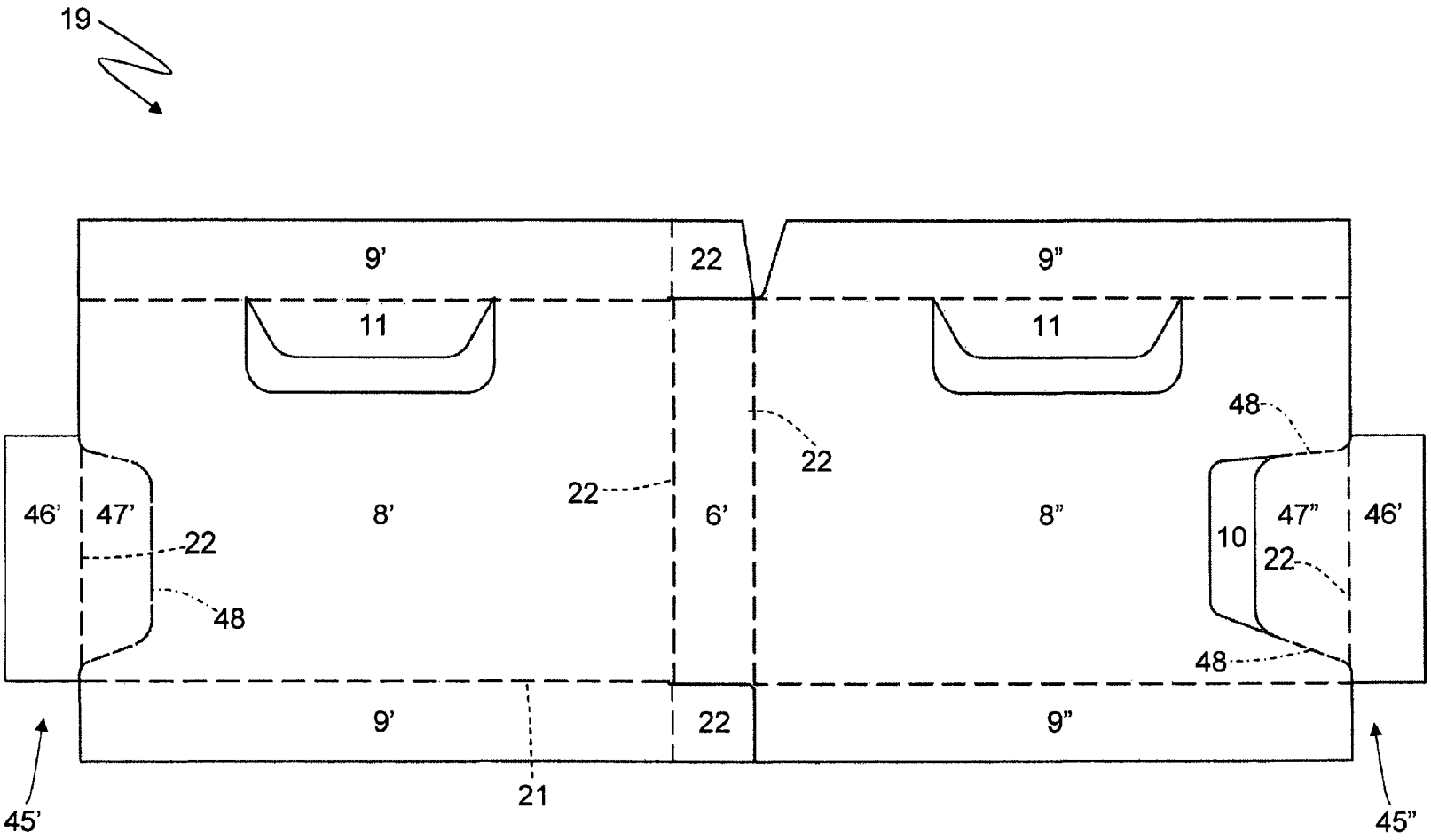
FIG. 36 shows a plan view of a variation of the FIG. 34 blank, from which to form an inner container of a rigid, straight-slide-open packet of cigarettes.
Figure 37:
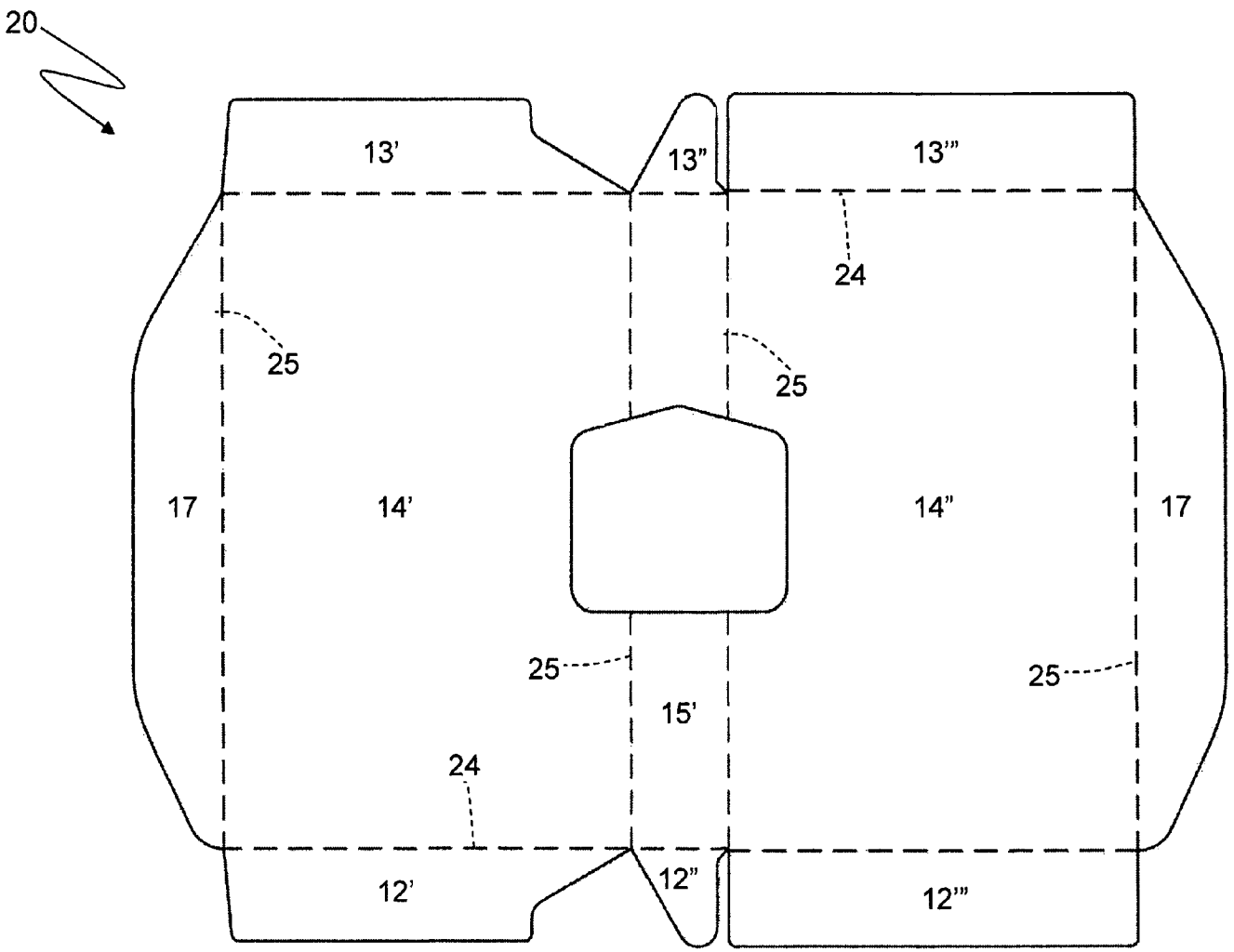
FIG. 37 shows a plan view of a variation of the FIG. 35 blank, from which to form an outer container of a rigid, straight-slide-open packet of cigarettes.

FIGS. 36 and 37 show respective blanks 19 and 20 from which to form a packet 1 of cigarettes similar to the one in FIGS. 31-33 (i.e. with the same design of tear-off lid 45), but in which container 4 translates with respect to container 5.

In one embodiment, sheet 29 of inner wrapping material is made of foil; inner package 2 is not stabilized at all, either by gluing or heat sealing; and the (each) tear line 32 is defined by a succession of spaced (typically, mechanically punched) through holes. In an alternative embodiment, sheet 29 of inner wrapping material is made of heat-seal multilayer material; and inner package 2 is stabilized by heat sealing (i.e. the superimposed portions of sheet 29 of inner wrapping material are heat sealed after they are folded). Stabilizing inner package 2 by heat sealing enables it to be sealed. In which case, the (each) tear line is defined by a partial incision (made, for example, by a laser beam) perpendicular to and through only part of the thickness of sheet 29 of inner wrapping material (more specifically, the partial incision does not cut through a plastic barrier layer designed to seal inner package 2 from the outside atmosphere.

In all the embodiments described, inner package 2 can be sealed by heat sealing, and the (each) tear line 32 can be defined by a partial incision that does not cut through a plastic barrier layer designed to seal inner package 2 from the outside atmosphere. This is especially true of the FIG. 23-25 embodiment, which is particularly suitable for employing an inner package 2 sealed by heat sealing, and in which the tear line 32 is defined by a partial incision that does not cut through a plastic barrier layer.

The embodiments described above refer to a rigid, slide-open packet 1 of cigarettes with a straight slide-open movement, but other types of rigid packets of cigarettes may also be employed, such as the rigid, swing-open packet of cigarettes described in WO2006021581A1, or the rigid, hinged-lid packet of cigarettes described in WO2008053320A2 or DE3627440A1.

The invention claimed is:

1. A packet (1) of cigarettes comprising:

a package (2) defined by a group (30) of cigarettes wrapped in a sheet (29) of wrapping material having at least one tear line (32) defining a tear-off top portion (31);

an inner container (4) housing the package (2) and having an extraction opening (10) for access to the tear-off top portion (31); and an outer container (5) housing the inner container (4) in sliding manner, to allow the inner container (4) to slide, with respect to the outer container (5), between a closed position, in which the inner container (4) is inserted inside the outer container (5), and an open position, in which the inner container (4) is extracted partly from the outer container (5) so that the extraction opening (10) of the inner container (4) is accessible from the outside;

retaining tabs (11, 17) limiting the outward travel of the inner container (4) to prevent the inner container (4) from detaching completely from the outer container (5);

a tear-off lid (45) connected to the inner container (4) by at least one tear line (48), and covering at least part of the extraction opening (10) of the inner container (4), and covering at least part of the tear-off top portion (31) of the package (2);

wherein the tear-off lid (45) is U-shaped, and comprises a top wall (46) covering a top wall of the package (2); and two lateral walls (47) covering part of two major lateral walls of the package (2), and coplanar with two major lateral walls (8) of the inner container (4); and wherein the top wall (46) of the tear-off lid (45) is not directly connected to any portion of the inner container (4) and is connected only to the two lateral walls (47) of the tear-off lid (45); and each lateral wall (47) of the tear-off lid (45) is connected to a respective major lateral wall (8) of the inner container (4) along at least one tear line (48).

2. A packet (1) of cigarettes as claimed in claim 1, wherein the inner container (4) has no top wall (7), so that, once the tear-off lid (45) is removed, a top wall of the package (2) is completely exposed.

3. A packet (1) of cigarettes as claimed in claim 1, wherein a first lateral wall (47) of the tear-off lid (45) is connected to a major lateral wall (8) of the inner container (4) along a single U-shaped tear line (48); and a second lateral wall (47) of the tear-off lid (45) is connected to a major lateral wall (8) of the inner container (4) along two tear lines (48) on opposite sides of the second lateral wall (47).

4. A packet (1) of cigarettes as claimed in claim 1, wherein the tear-off lid (45) leaves at least part of the extraction opening (10) uncovered, so as to form a grip by which to grip and remove the tear-off lid (45) easily.

5. A packet (1) of cigarettes as claimed in claim 4, wherein the top wall (46) of the tear-off lid (45) is smaller than the top wall of the package (2).

6. A packet (1) of cigarettes as claimed in claim 4, wherein at least one part of the extraction opening (10) left uncovered by the tear-off lid (45) is located on a major lateral wall (8) of the inner container (4).

7. A packet (1) of cigarettes as claimed in claim 6, wherein the tear-off lid (45) leaves uncovered two separate parts of the extraction opening (10), located symmetrically on two major lateral walls (8) of the inner container (4); or the tear-off lid (45) only leaves uncovered one part of the extraction opening (10), located asymmetrically on one major lateral wall (8) of the inner container (4).

8. A packet (1) of cigarettes as claimed in claim 1, wherein the tear-off lid (45) is formed by superimposing and gluing together two separate panels (45', 45").

9. A packet (1) of cigarettes as claimed in claim 1, wherein the tear-off lid (45) is glued to the tear-off top portion (31) of the package (2).

10. A packet (1) of cigarettes as claimed in claim 1, wherein the tear-off top portion (31) of the inner package (2) is defined by two separate overlapping portions (31*a*, 31*b*) of the sheet (29) of wrapping material.

11. A packet (1) of cigarettes as claimed in claim 10, wherein the two overlapping portions (31*a*, 31*b*) of the sheet (29) of wrapping material are glued to each other.

12. A packet (1) of cigarettes as claimed in one of claim 1, wherein:

the group (30) of cigarettes is substantially parallelepiped-shaped with a rectangular cross section, and has two parallel, opposite major lateral walls (34) defined by cylindrical lateral walls of the cigarettes, two parallel, opposite minor lateral walls (35) defined by cylindrical lateral walls of the cigarettes, and two parallel, opposite end walls (36) defined by flat ends of the cigarettes; four longitudinal edges (37) are defined between the two major lateral walls (34) and the two minor lateral walls (35), four major transverse edges (38) are defined between the two major lateral walls (34) and the two end walls (36), and four minor transverse edges (39) are defined between the two minor lateral walls (35) and the two end walls (36);

the sheet (29) of wrapping material is folded about the group (30) of cigarettes by superimposing two opposite flaps (40, 41) of the sheet (29) of wrapping material to form a tubular wrapping enclosing the group (30) of cigarettes seamlessly on all four sides, and having, at the minor lateral walls (35) of the group (30) of cigarettes, two lateral ends which are folded to complete the inner package (2);

the tear-off top portion (31) extends seamlessly over a single portion of the sheet (29) of wrapping material; and the opposite flaps (40, 41) of the sheet (29) of wrapping material are only superimposed on a first major lateral wall (34*a*) of the group (30) of cigarettes.

13. A packet (1) of cigarettes as claimed in claim 12, wherein, at a first minor transverse edge (39*a*) of the group (30) of cigarettes involving the tear-off top portion (31), the sheet (29) of wrapping material has a tab (33) formed from part of the tear-off top portion (31) and astride the first minor transverse edge (39*a*).

14. A packet (1) of cigarettes as claimed in claim 13, wherein the tab (33) is folded onto a first end wall (36*b*) of the group (30) of cigarettes.

* * * * *